US011588283B2

(12) United States Patent
Chiang

(10) Patent No.: US 11,588,283 B2
(45) Date of Patent: Feb. 21, 2023

(54) COAXIAL CONNECTOR

(71) Applicant: BO-JIANG TECHNOLOGY CO., LTD., Tainan (TW)

(72) Inventor: Chang-Hui Chiang, Tainan (TW)

(73) Assignee: BO-JIANG TECHNOLOGY CO., LTD., Tainan (TW)

( * ) Notice: Subject to any disclaimer, the term of this patent is extended or adjusted under 35 U.S.C. 154(b) by 84 days.

(21) Appl. No.: 17/404,998

(22) Filed: Aug. 17, 2021

(65) Prior Publication Data

US 2022/0329022 A1 Oct. 13, 2022

(30) Foreign Application Priority Data

Apr. 7, 2021 (TW) ..... 110203738

(51) Int. Cl.

| | |
|---|---|
| ***H01R 24/40*** | (2011.01) |
| ***H01R 13/629*** | (2006.01) |
| ***H01R 13/40*** | (2006.01) |
| ***H01R 13/502*** | (2006.01) |
| ***H01R 103/00*** | (2006.01) |

(52) U.S. Cl.

CPC ..... *H01R 24/40* (2013.01); *H01R 13/40* (2013.01); *H01R 13/502* (2013.01); *H01R 13/629* (2013.01); *H01R 2103/00* (2013.01)

(58) Field of Classification Search

CPC .. H01R 2103/00; H01R 24/40; H01R 13/629; H01R 13/40; H01R 13/502

USPC ..... 439/578

See application file for complete search history.

(56) References Cited

U.S. PATENT DOCUMENTS

| | | | | | |
|---|---|---|---|---|---|
| 4,775,325 | A * | 10/1988 | Wilson | H01R 13/405 | 439/675 |
| 4,907,983 | A * | 3/1990 | Wilson | H01R 13/405 | 439/675 |
| 4,934,960 | A * | 6/1990 | Capp | H01R 13/6625 | 439/620.09 |
| 4,943,245 | A * | 7/1990 | Lincoln | H01R 24/44 | 439/578 |
| 8,992,250 | B1 * | 3/2015 | Hosier, Sr. | H01R 13/622 | 439/582 |
| 2010/0304607 | A1 * | 12/2010 | Mana | H01R 13/533 | 439/578 |
| 2017/0110838 | A1 * | 4/2017 | Sasaki | H01R 13/5205 | |

* cited by examiner

*Primary Examiner* — Gary F Paumen

(74) *Attorney, Agent, or Firm* — Li & Cai Intellectual Property Office

(57) ABSTRACT

A coaxial connector is provided. The coaxial connector includes a shell, a core body, and a fixing member. The shell has a central passage. The shell includes a first annular portion, a second annular portion, an annular engaging portion, and an annular abutting portion. The fixing member has a thru-hole. The fixing member includes a first portion, a second portion, and an engaging portion. The core body fixedly penetrates through the thru-hole of the fixing member. An inner diameter of the annular engaging portion gradually increases from one end of the shell to another end of the shell. The annular engaging portion has a first annular inclined surface, and the fixing member has a second annular inclined surface. The fixing member is engaged in the central passage, and the first annular inclined surface and the second annular inclined surface abut against each other.

14 Claims, 21 Drawing Sheets

COAXIAL CONNECTOR

CROSS-REFERENCE TO RELATED PATENT APPLICATION

This application claims the benefit of priority to Taiwan Patent Application No. 110203738, filed on Apr. 7, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a coaxial connector, and more particularly to a coaxial connector applicable to transmit a high frequency signal having a frequency higher than 10 GHz.

BACKGROUND OF THE DISCLOSURE

When a conventional high-frequency coaxial connector is used to transmit a high frequency signal having a frequency higher than 10 GHz, issues relating to convex waves can easily occur.

SUMMARY OF THE DISCLOSURE

In response to the above-referenced technical inadequacy, the present disclosure provides a coaxial connector to improve an issue associated with a conventional high-frequency coaxial connector. That is, when the conventional high-frequency coaxial connector is used to transmit a high frequency signal having a frequency higher than 10 GHz, issues relating to convex waves can easily occur.

In one aspect, the present disclosure provides a coaxial connector. The coaxial connector includes a shell, a core body, and a fixing member. The shell defines a first end and a second end opposite to each other. The shell has a central passage penetrating through the shell along an axial direction, and the shell includes a first annular portion, a second annular portion, an annular engaging portion, and an annular abutting portion. The first annular portion is arranged near the first end. The second annular portion has an inner diameter greater than or equal to an inner diameter of the first annular portion. The annular engaging portion is connected to the first annular portion and the second annular portion and arranged between the first annular portion and the second annular portion. An inner diameter of the annular engaging portion gradually increases from the first end to the second end, and the annular engaging portion has a first annular inclined surface. A minimum inner diameter of the annular engaging portion is less than or equal to the inner diameter of the first annular portion. The annular abutting portion is arranged near the second end and connected to the second annular portion. An inner diameter of the annular abutting portion is less than an inner diameter of the second annular portion, and the annular abutting portion has a first annular abutting surface at one end thereof near the second annular portion. The core body has at least one portion disposed in the shell. The fixing member has a thru-hole. One portion of the core body is fixed in the thru-hole, the fixing member is disposed in the central passage, the fixing member defines a third end and a fourth end opposite to each other, and the fixing member includes a first portion, a second portion, and an engaging portion. The first portion is arranged near the third end, and an outer diameter of the first portion is less than the inner diameter of the first annular portion. The second portion has an outer diameter greater than the outer diameter of the first portion, and the outer diameter of the second portion is less than the inner diameter of the second annular portion. The engaging portion is connected to the first portion and the second portion and arranged between the first portion and the second portion. An outer diameter of the engaging portion gradually increases from the third end to the fourth end, and the engaging portion has a second annular inclined surface. The outer diameter of the second portion is greater than or equal to a maximum outer diameter of the engaging portion. The fixing member has a second annular abutting surface at the fourth end. The core body is fixed in the central passage through the fixing member, the annular engaging portion and the annular abutting portion jointly hold the engaging portion and the second portion, the second annular abutting surface and the first annular abutting surface abut against each other, and one portion of the first annular inclined surface and one portion of the second annular inclined surface abut against each other.

Therefore, compared to the conventional coaxial connector, when the coaxial connector of the present disclosure is used to transmit a high-frequency signal having a frequency higher than 10 GHz, issues relating to convex waves do not easily occur.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
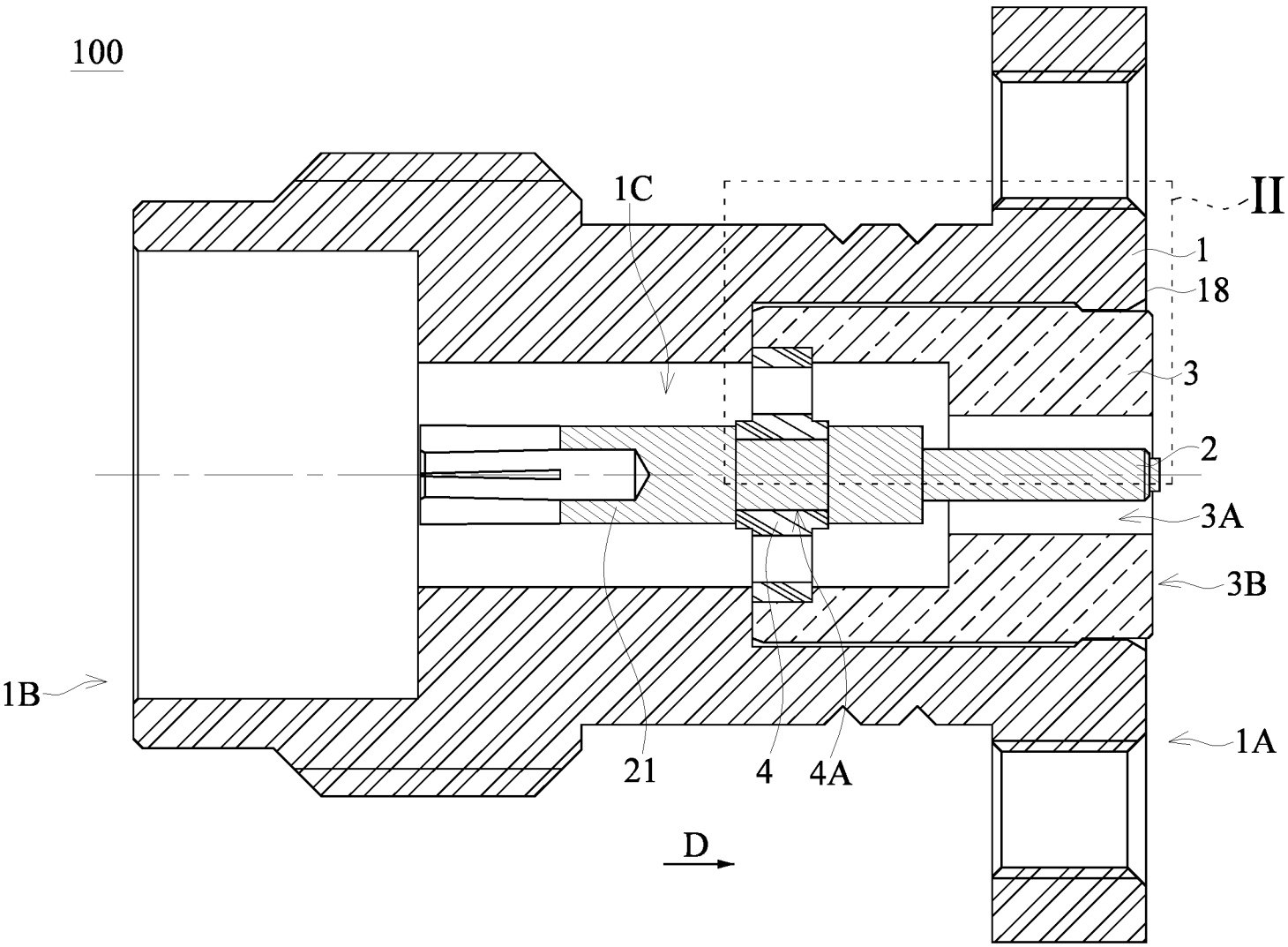
FIG. 1 is a sectional view of a coaxial connector according to a first embodiment of the present disclosure.
Figure 2:
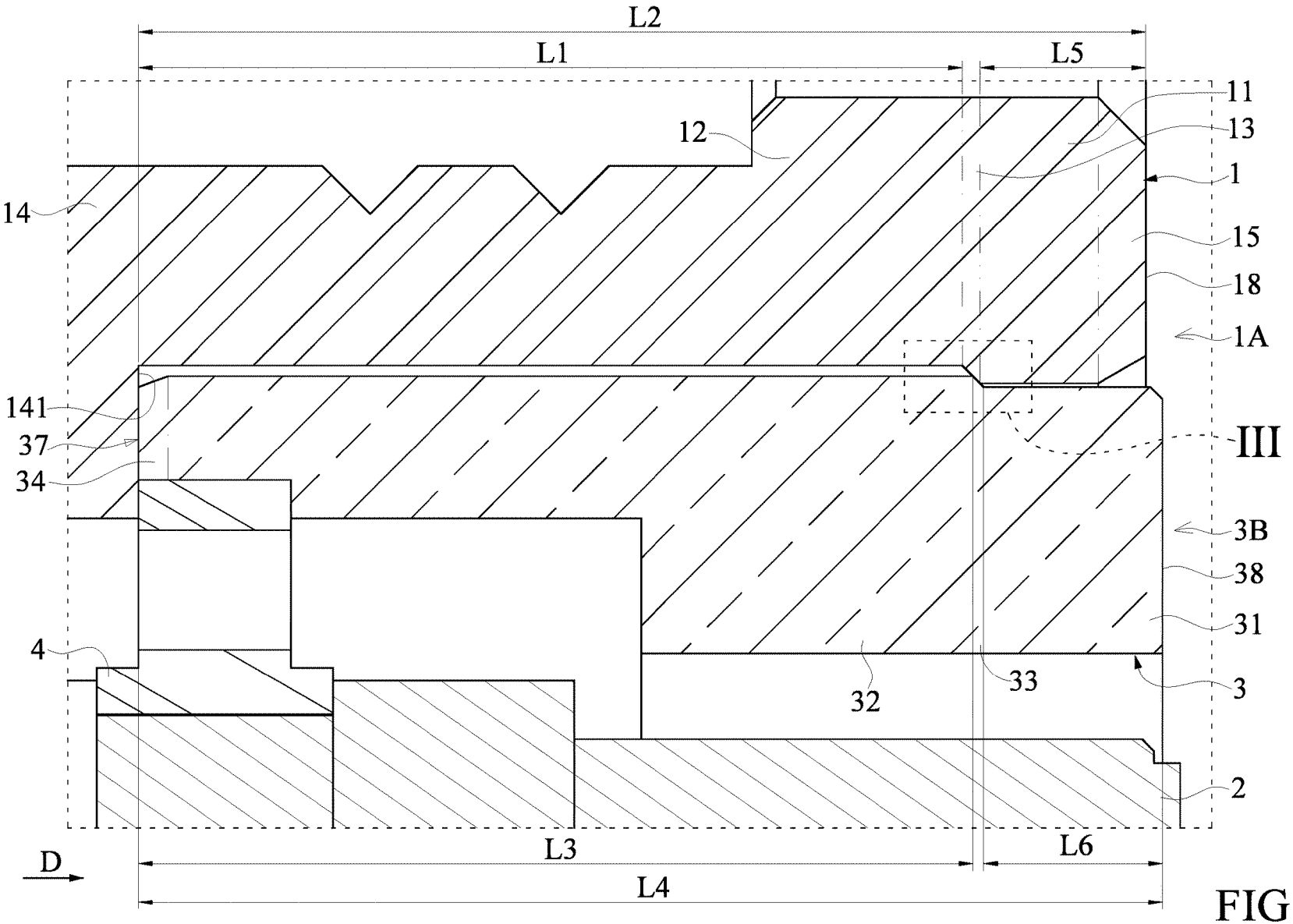
FIG. 2 is a partial enlarged view of FIG. 1.
Figure 3:
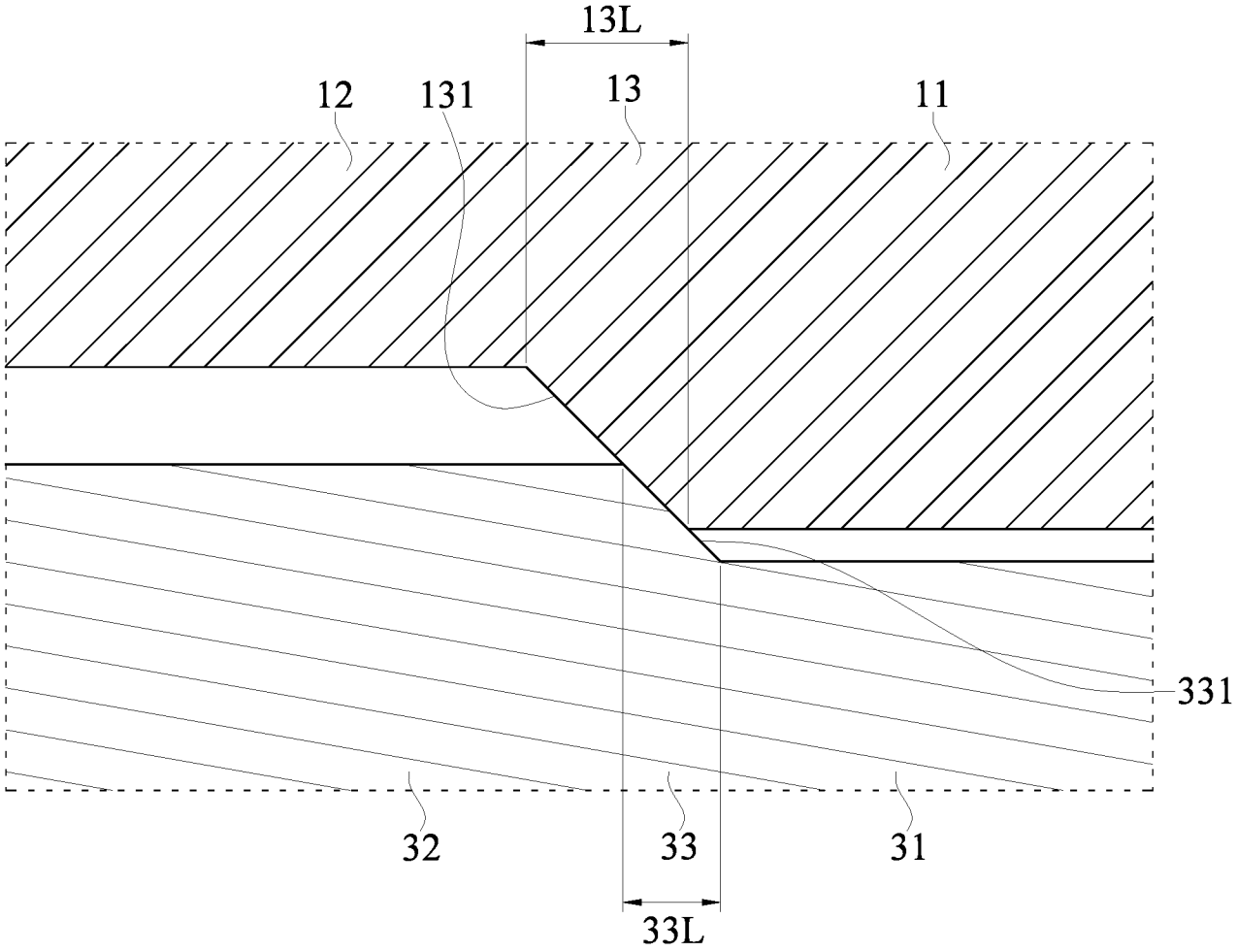
FIG. 3 is a partial enlarged view of FIG. 2.
Figure 4:
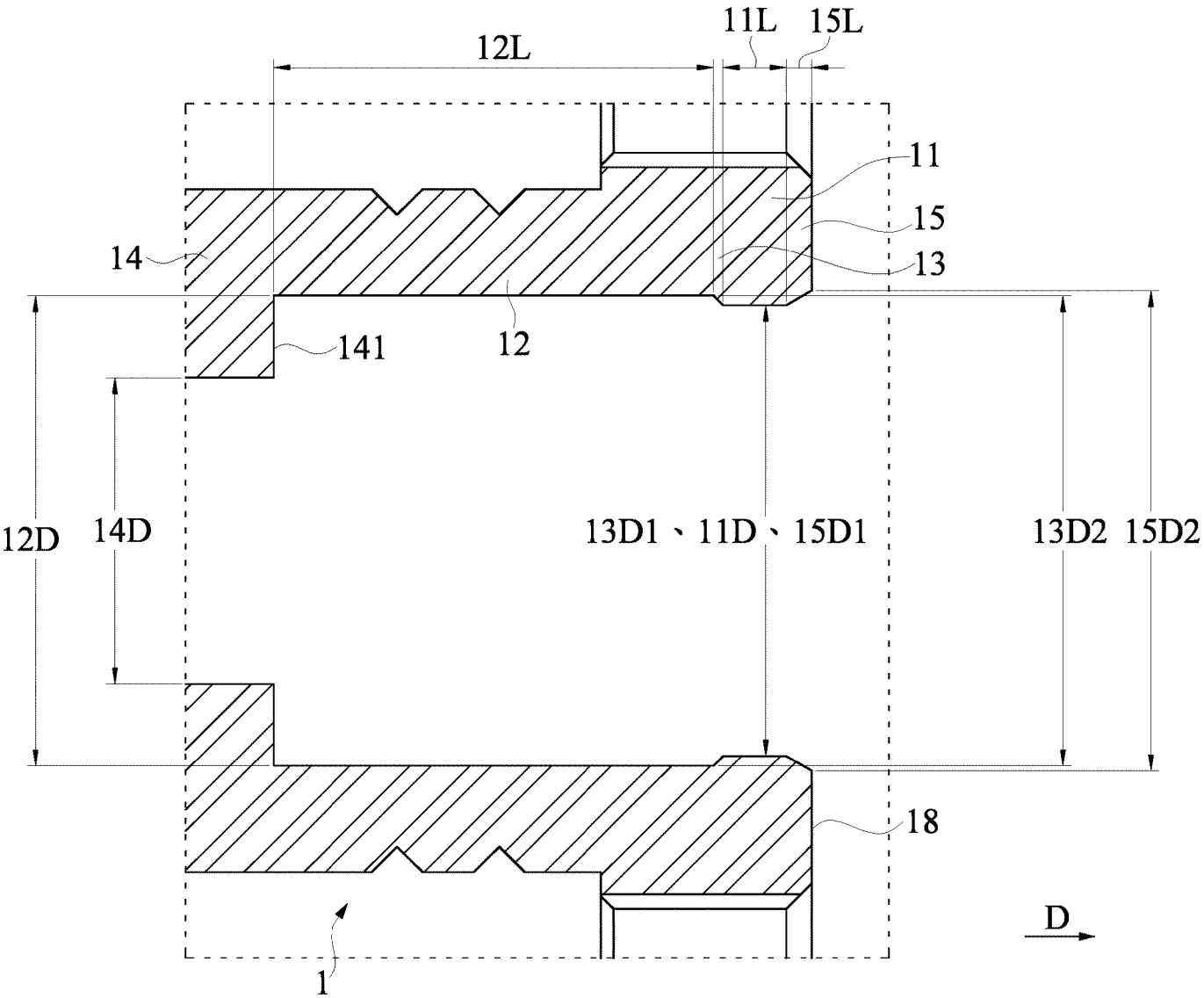
FIG. 4 is a partial sectional view of a shell of the coaxial connector according to the first embodiment of the present disclosure.
Figure 5:
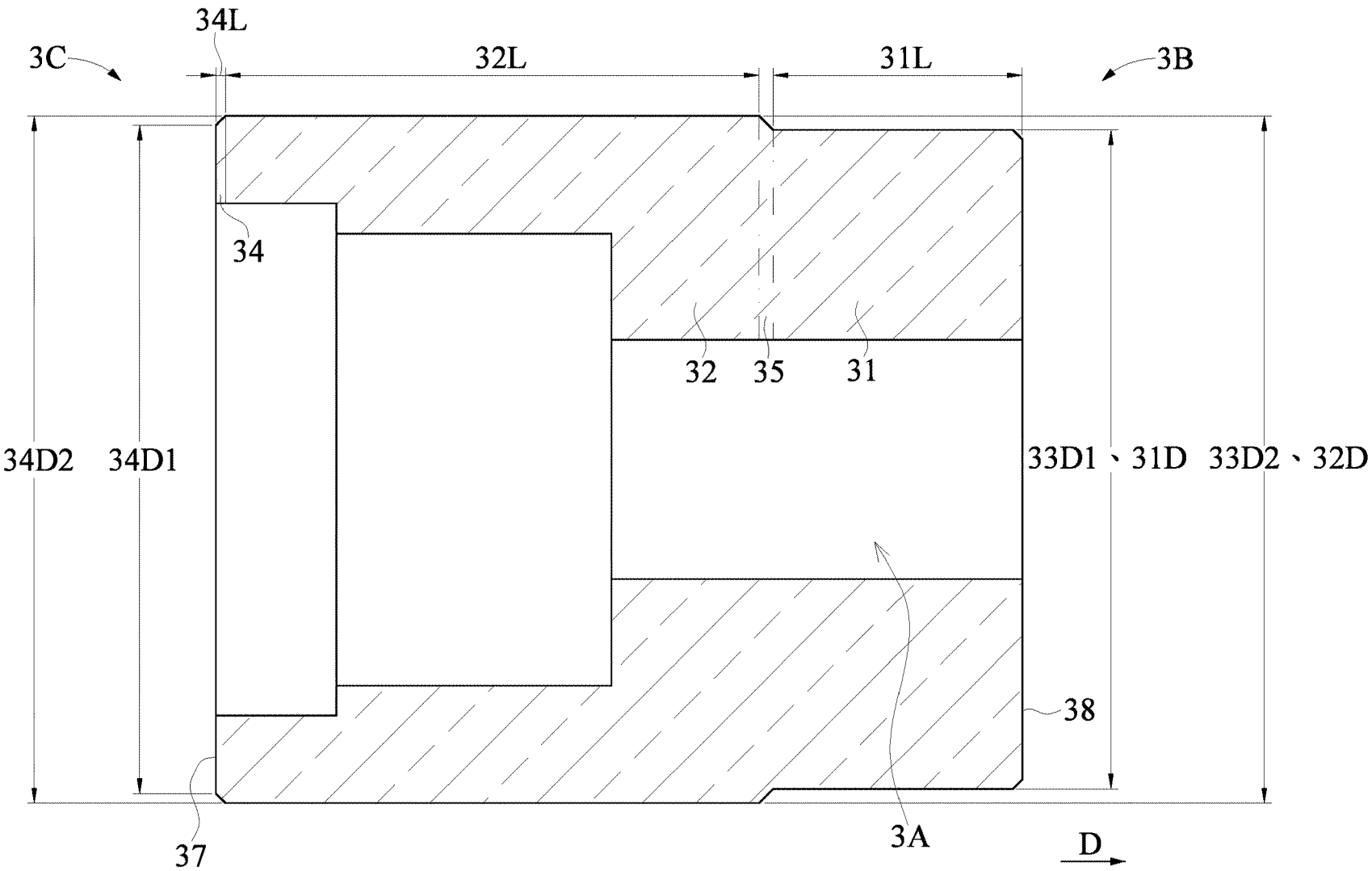
FIG. 5 is a sectional view of a fixing member of the coaxial connector according to the first embodiment of the present disclosure.
Figure 6:
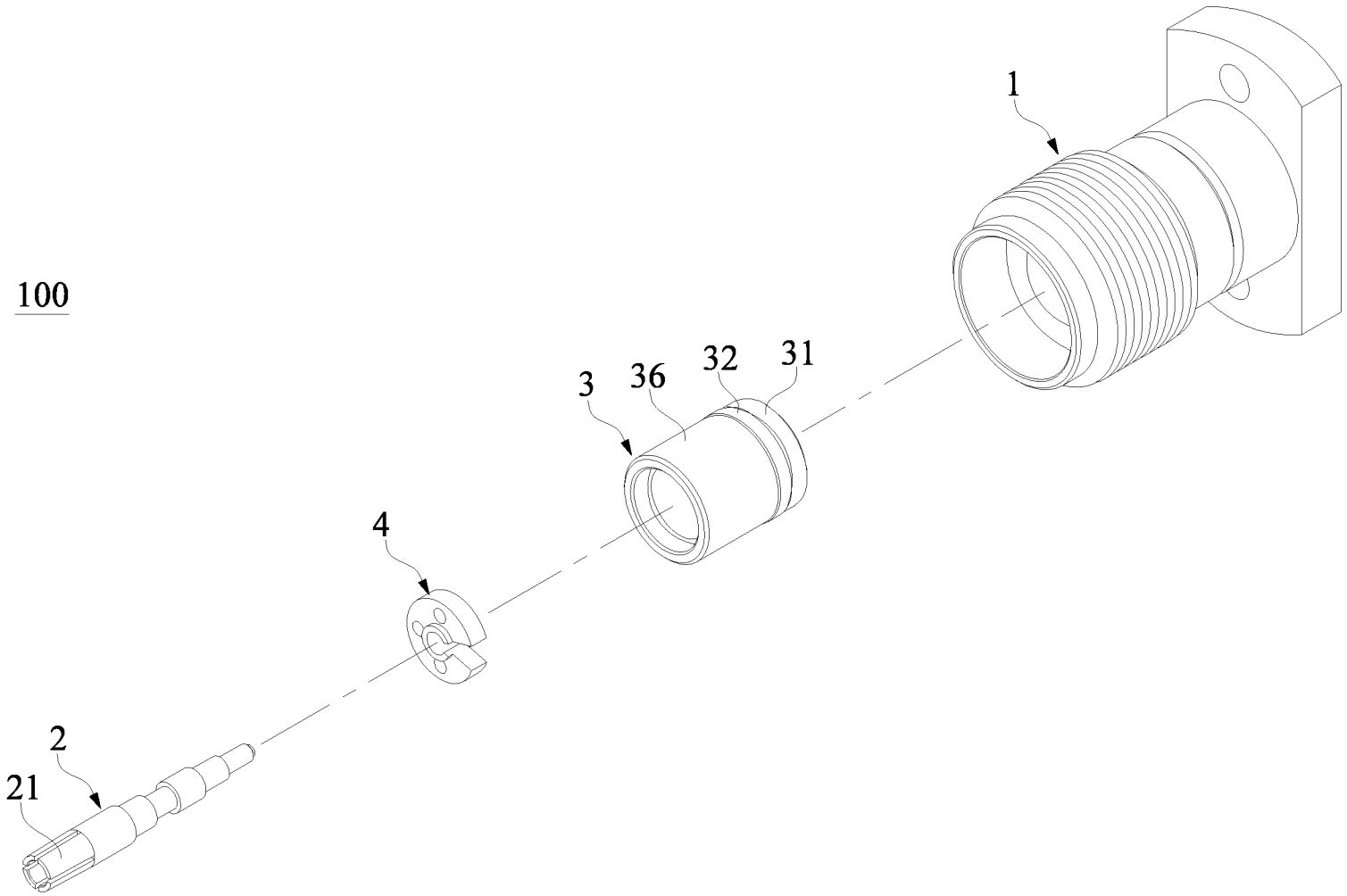
FIG. 6 is an exploded view of the coaxial connector according to a third embodiment of the present disclosure.
Figure 7:
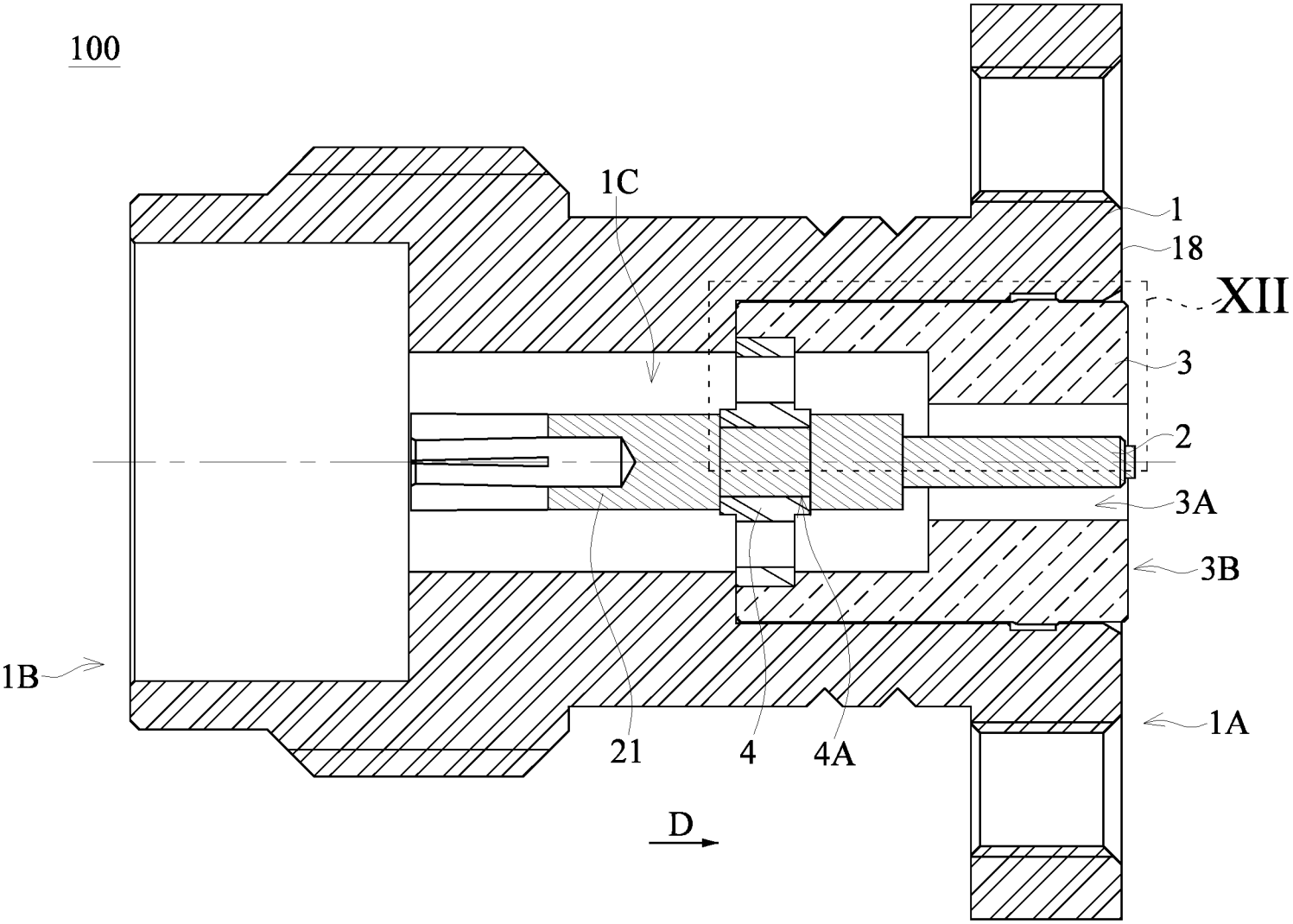
FIG. 7 is a sectional view of the coaxial connector according to the third embodiment of the present disclosure.
Figure 8:
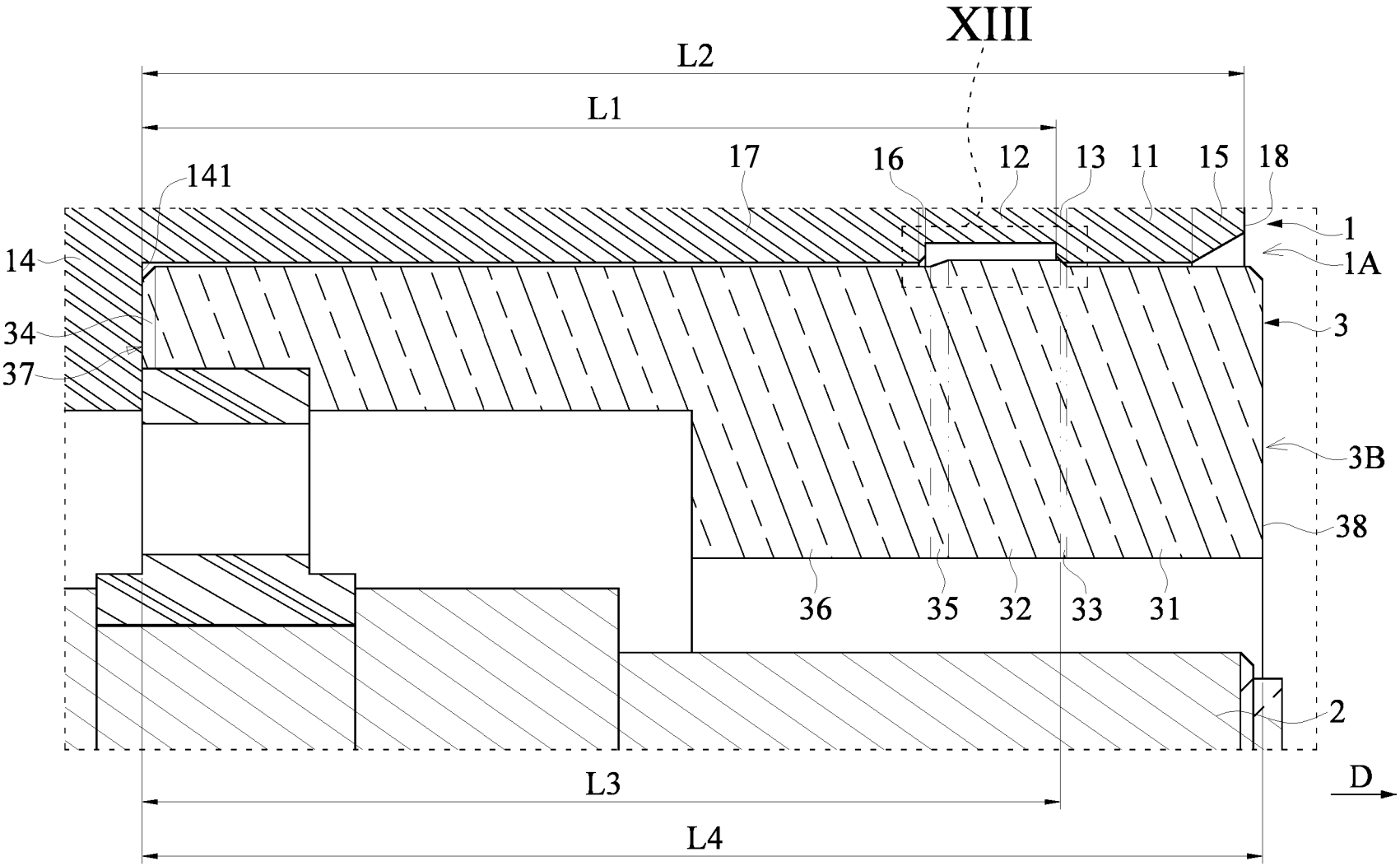
FIG. 8 is a partial enlarged view of FIG. 7.
Figure 9:
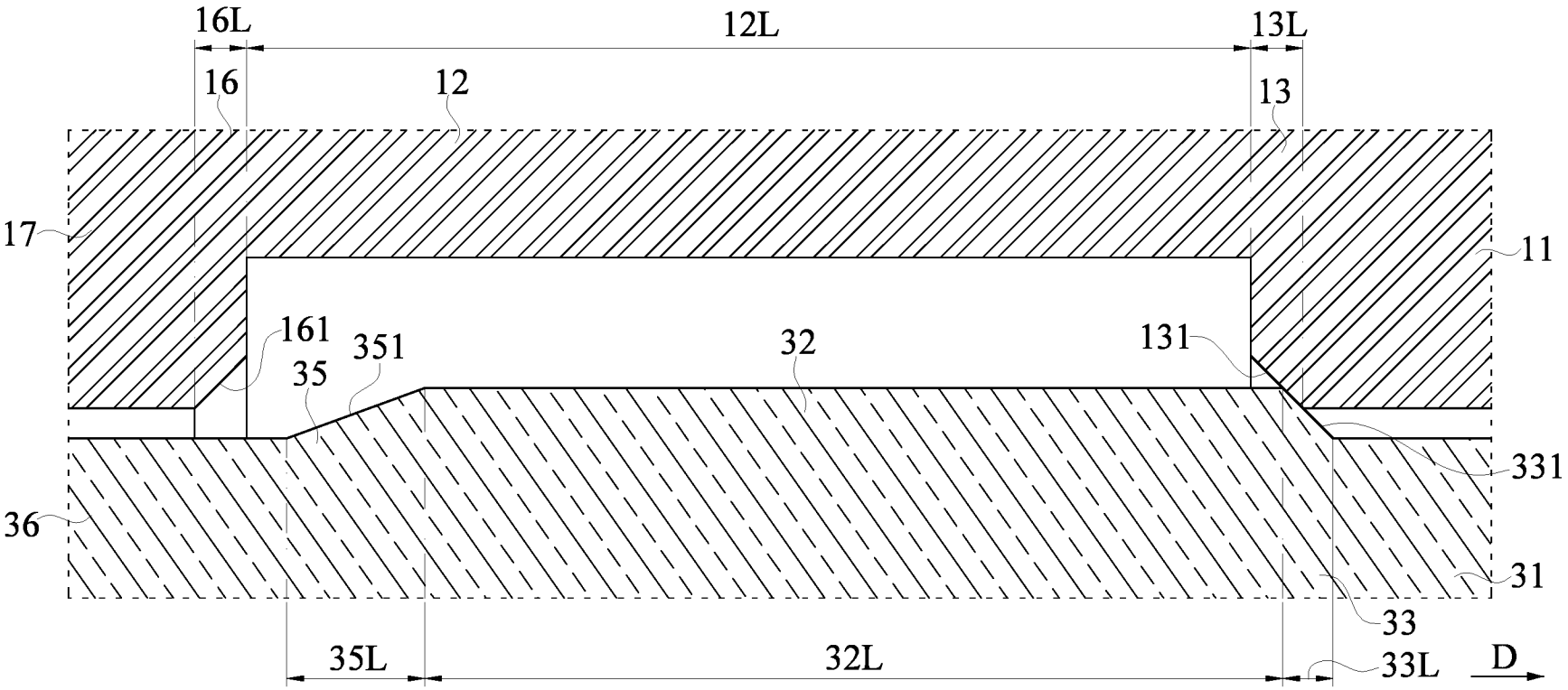
FIG. 9 is a partial sectional view of FIG. 8.
Figure 10:
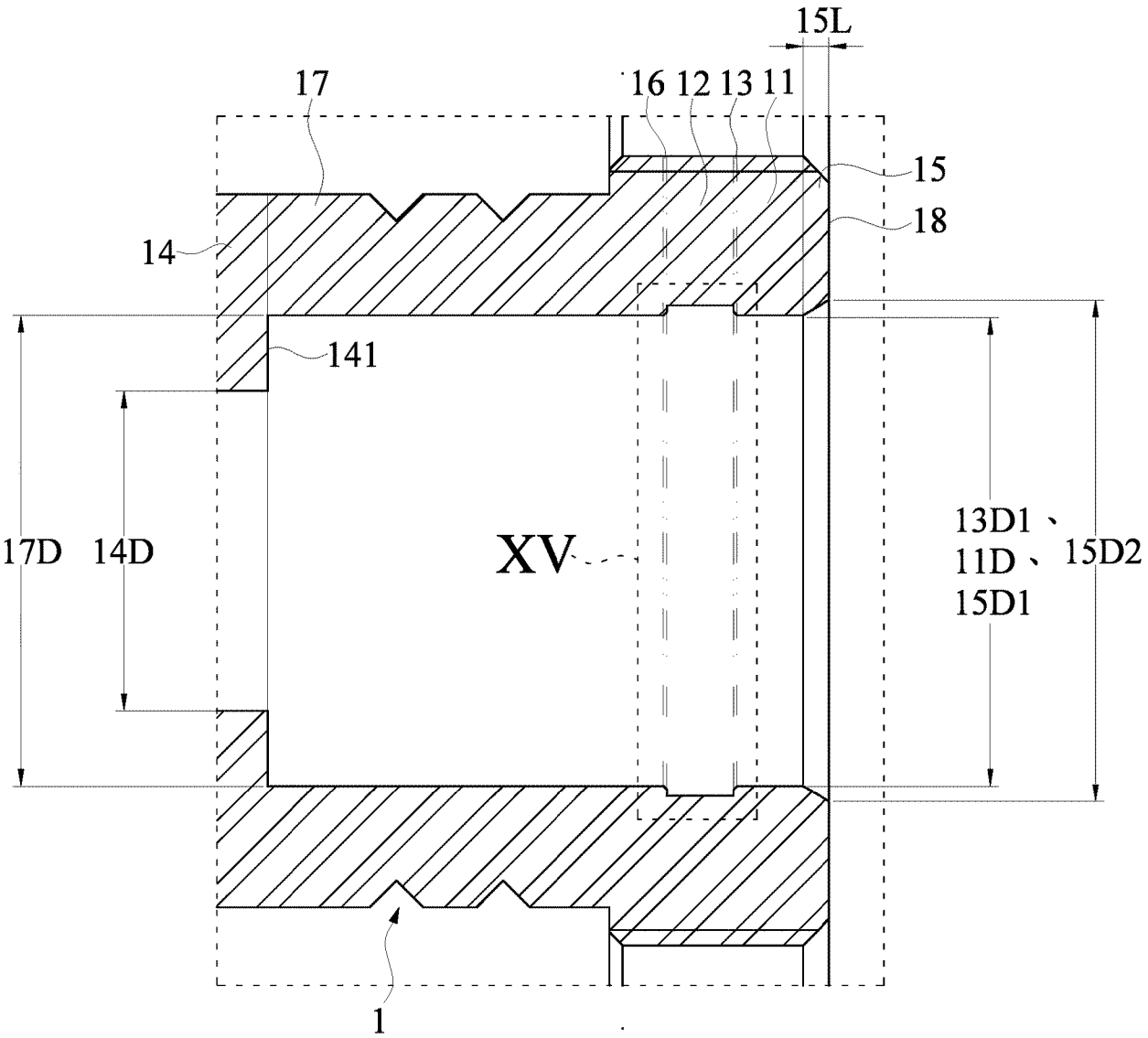
FIG. 10 is a partial sectional view of the fixing member of the coaxial connector according to the third embodiment of the present disclosure.
Figure 11:
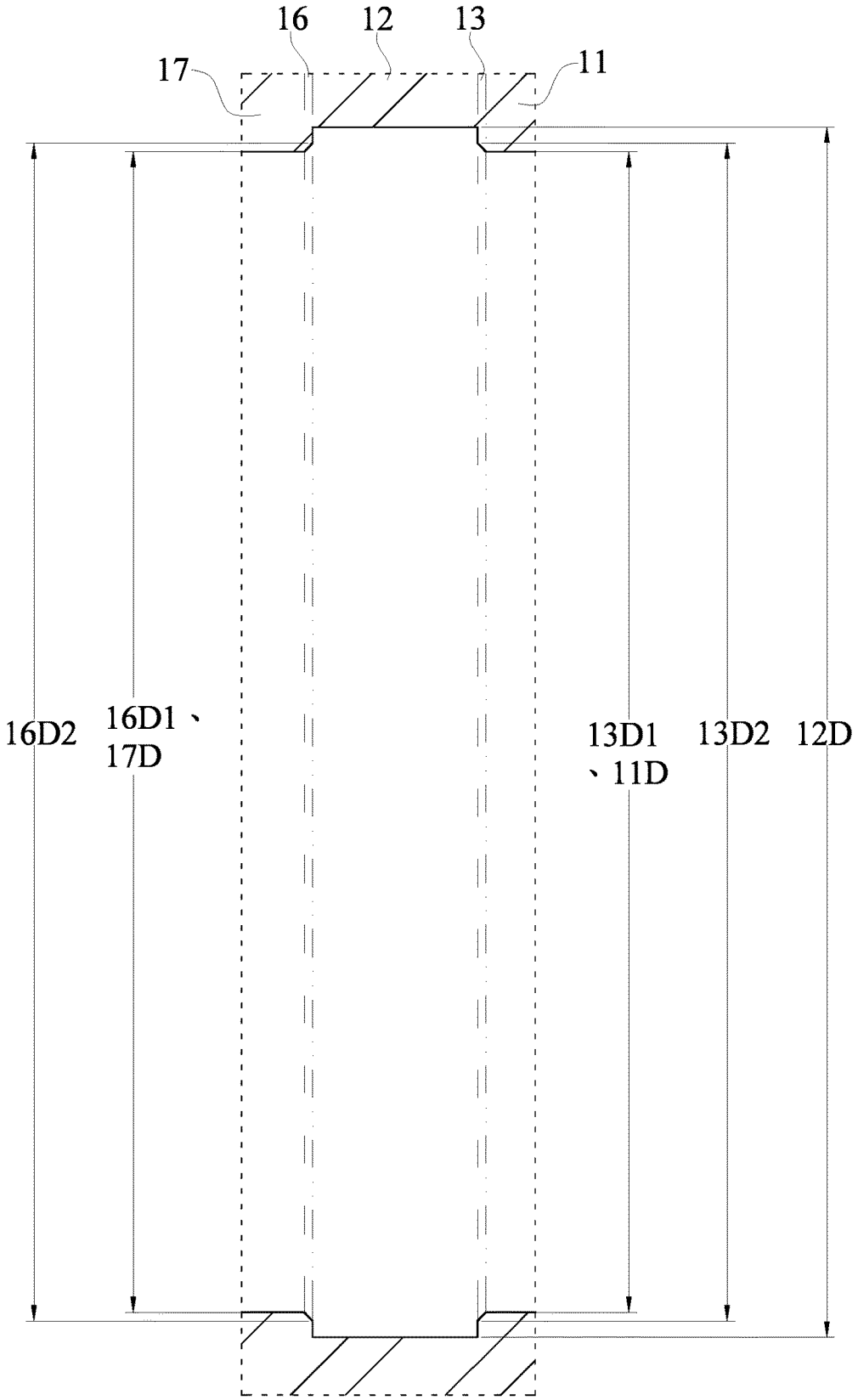
FIG. 11 is a partial enlarged view of FIG. 10.
Figure 12:
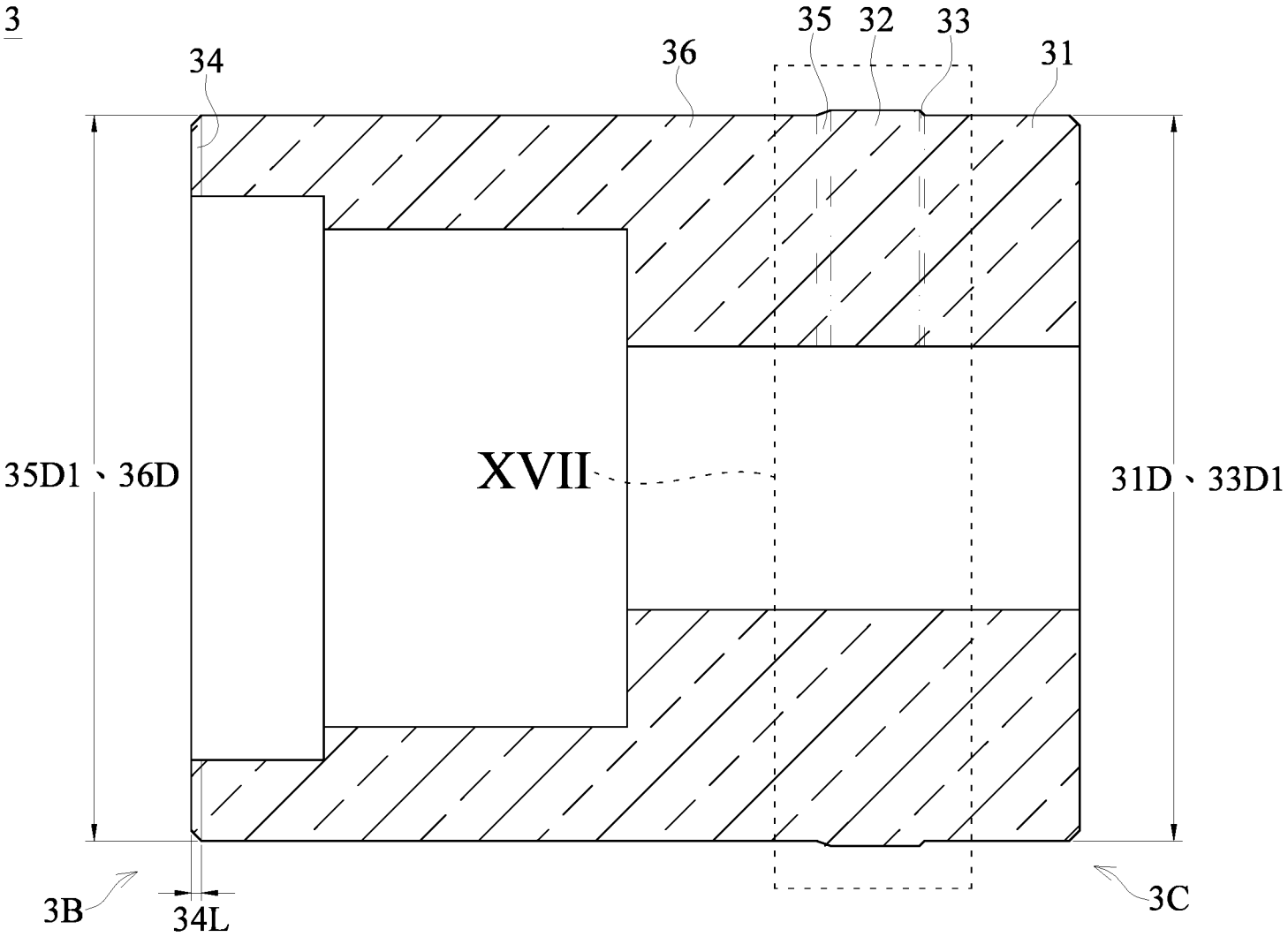
FIG. 12 is a sectional view of the fixing member of the coaxial connector according to the third embodiment of the present disclosure.
Figure 13:
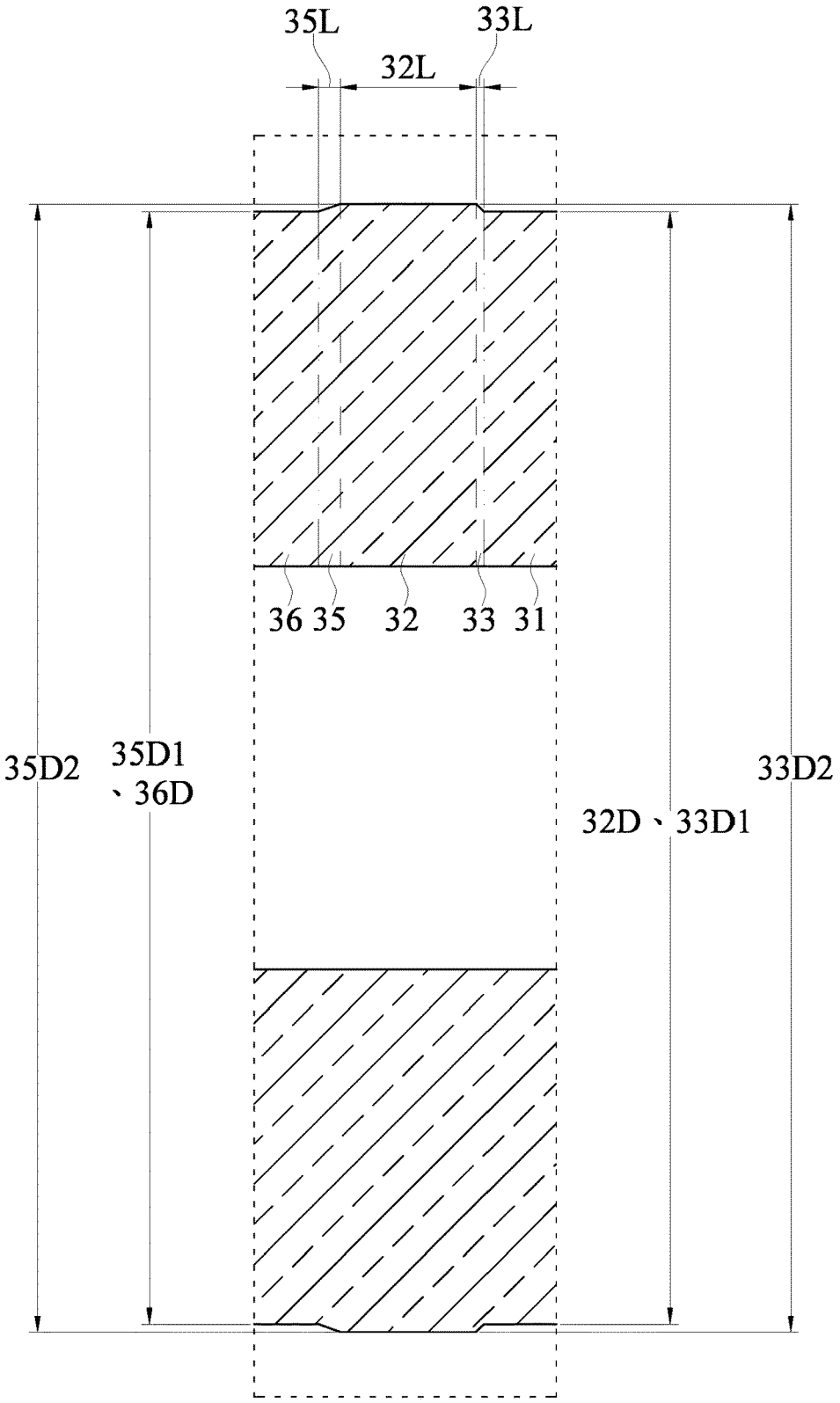
FIG. 13 is a partial enlarged view of FIG. 12.
Figure 14:
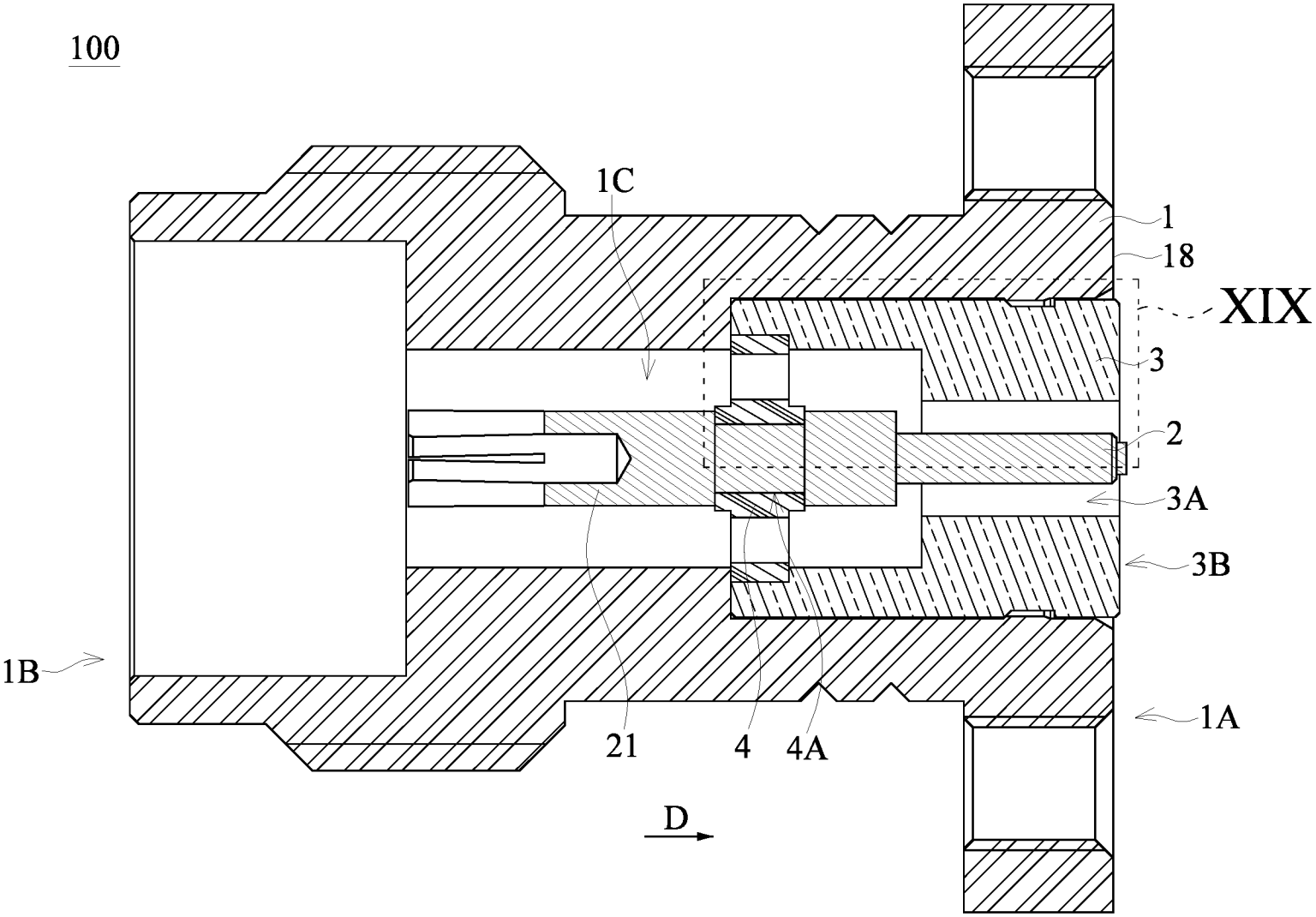
FIG. 14 is a sectional view of the coaxial connector according to a fourth embodiment of the present disclosure.
Figure 15:
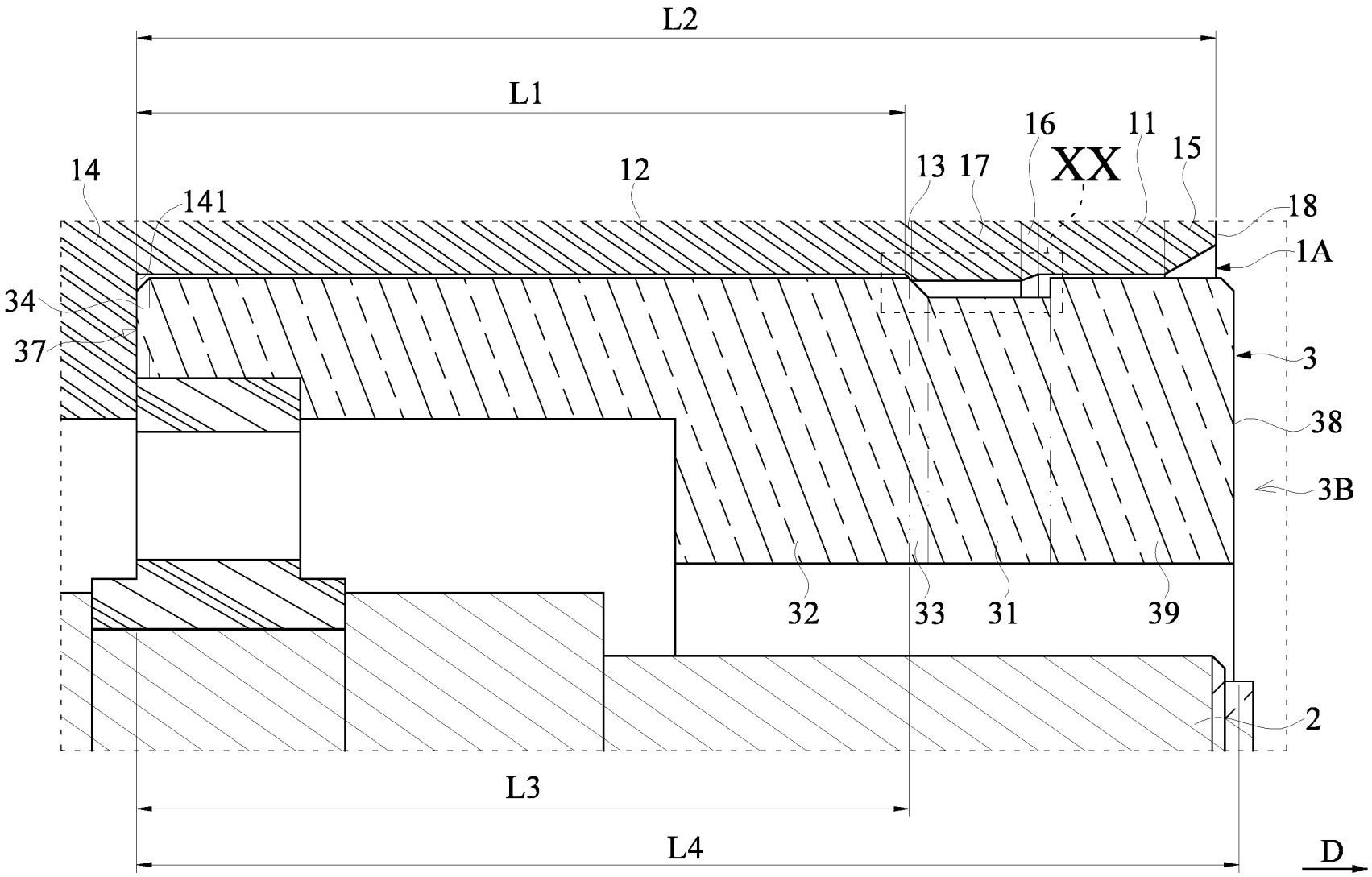
FIG. 15 is a partial enlarged view of FIG. 14.
Figure 16:
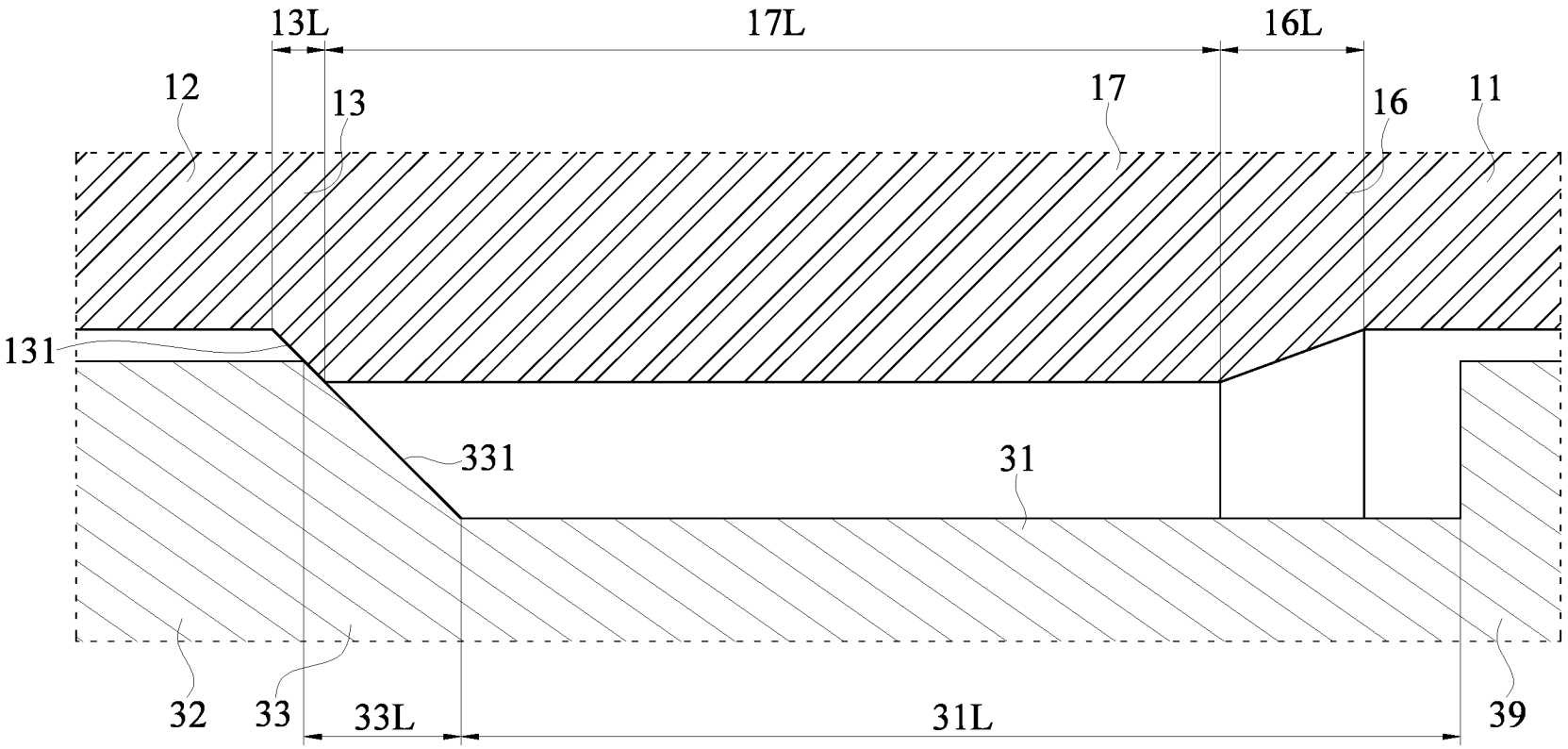
FIG. 16 is a partial enlarged view of FIG. 15.
Figure 17:
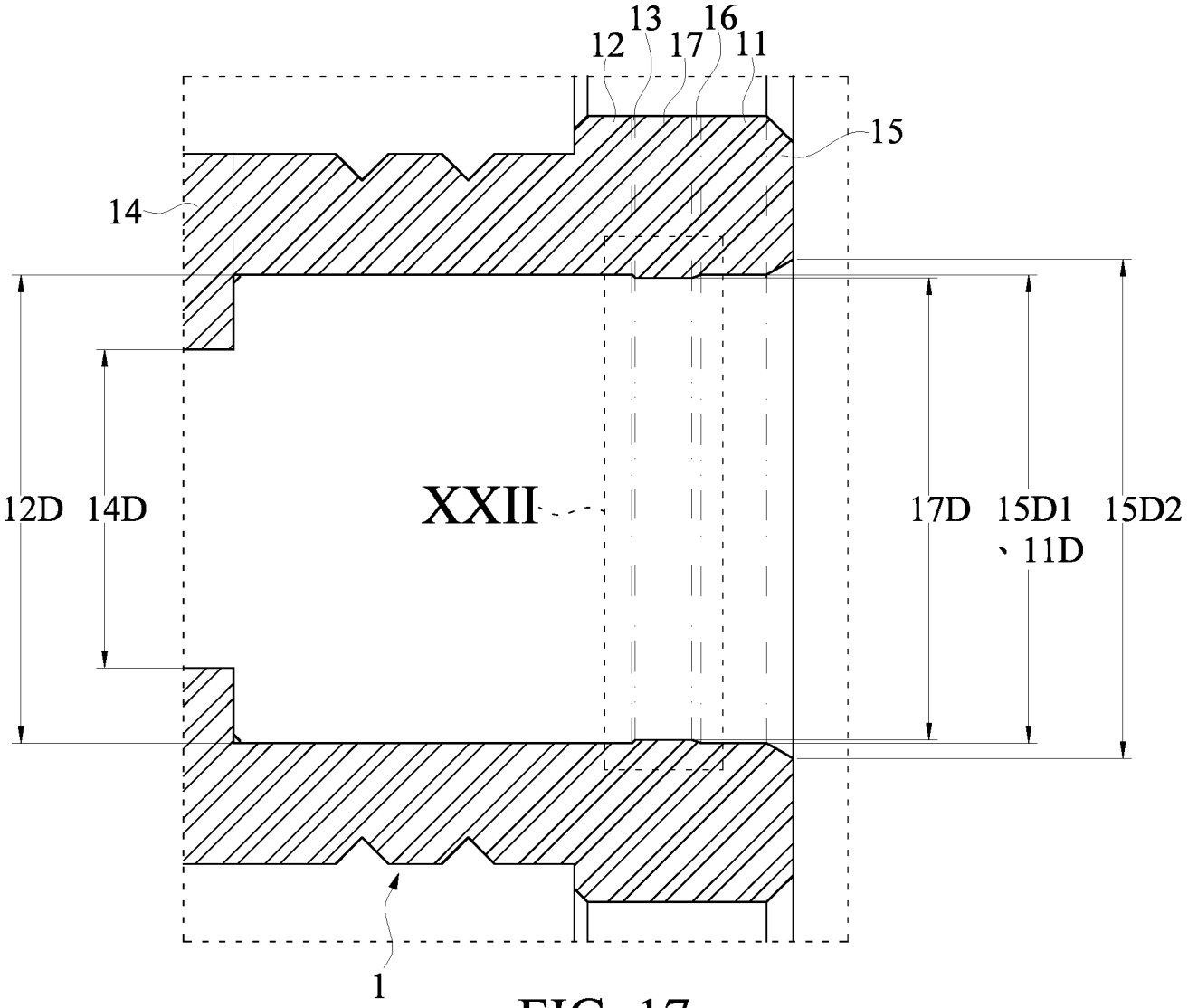
FIG. 17 is a partial sectional view of the shell of the coaxial connector according to the fourth embodiment of the present disclosure.
Figure 18:
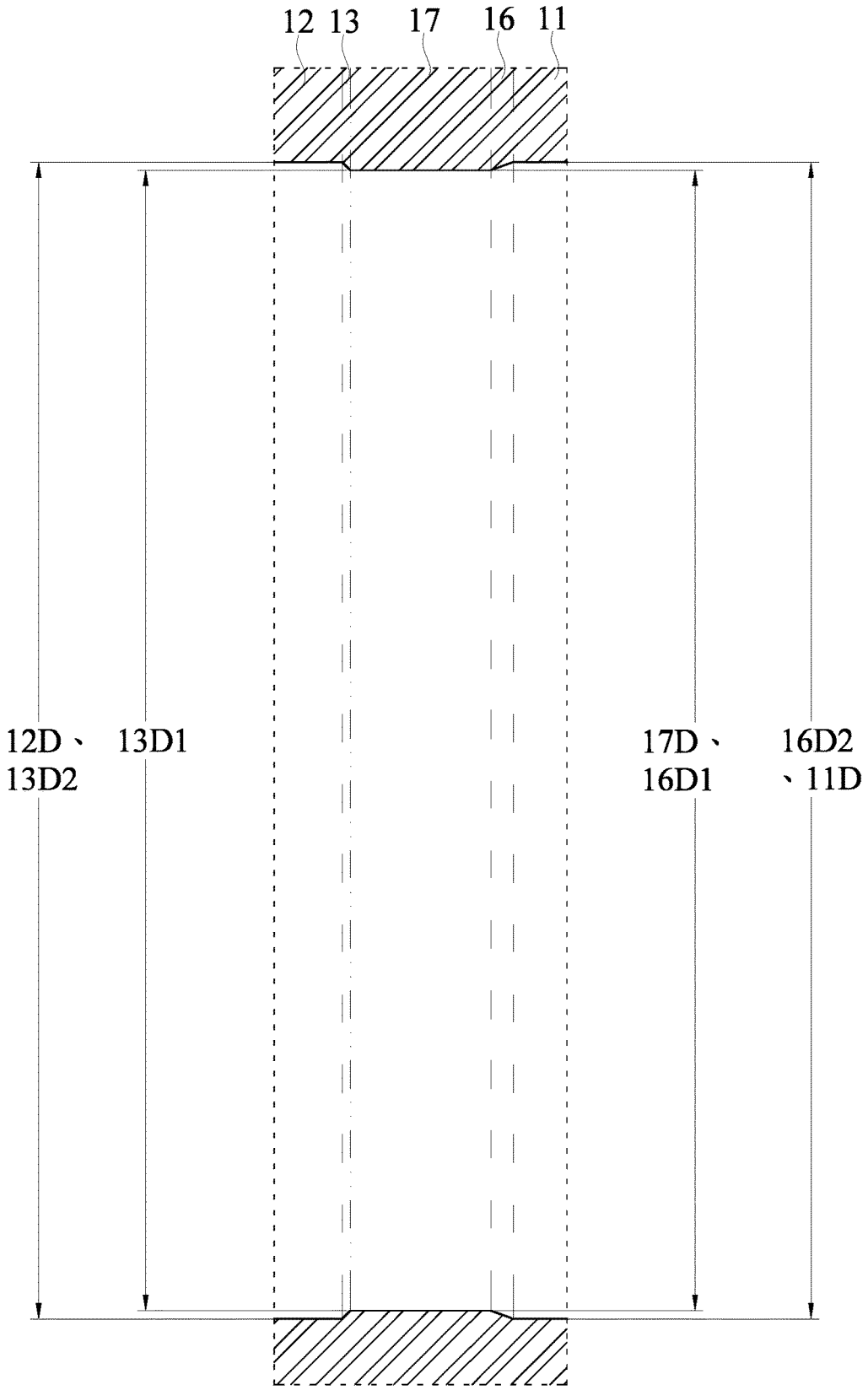
FIG. 18 is a partial enlarged view of FIG. 17.
Figure 19:
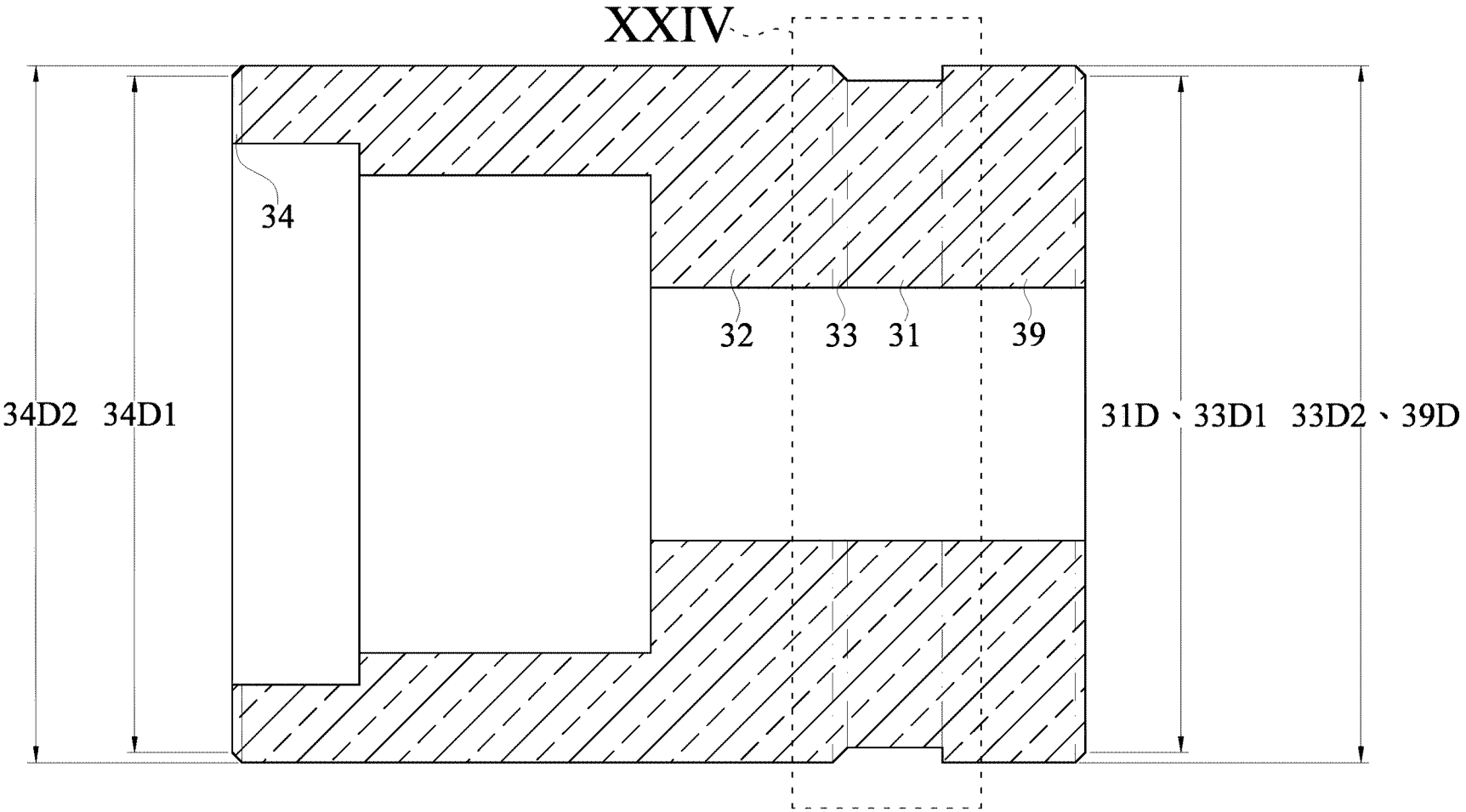
FIG. 19 is a sectional view of the fixing member of the coaxial connector according to the fourth embodiment of the present disclosure.
Figure 20:
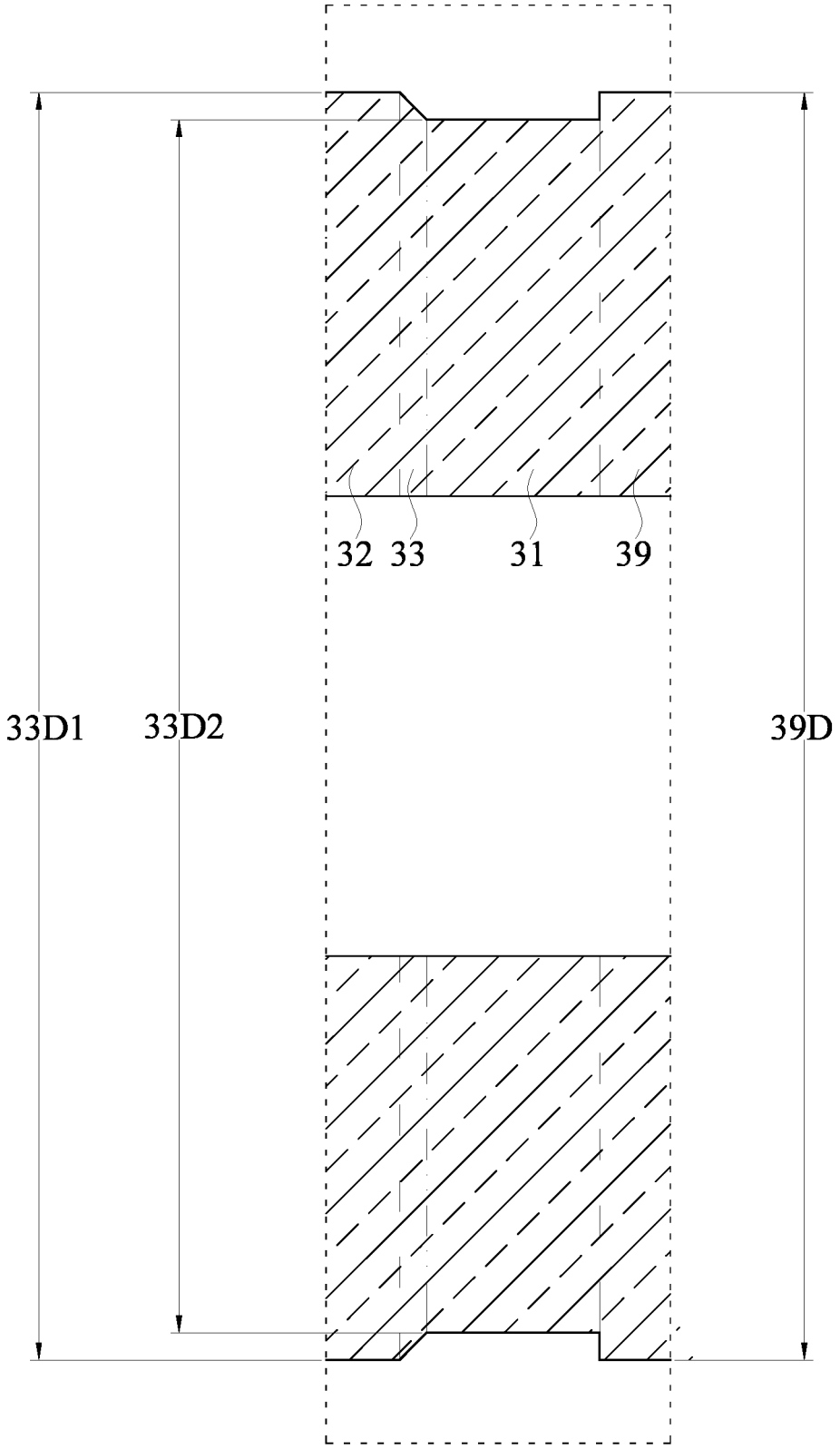
FIG. 20 is a partial enlarged view of FIG. 19.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 5, a coaxial connector 100 of the present disclosure includes a shell 1, a core body 2, and a fixing member 3. The core body 2 is disposed in the fixing member 3, the fixing member 3 having the core body 2 disposed therein is disposed in the shell 1, and two ends of the core body 2 are exposed from the shell 1. One end of the coaxial connector 100 of the present embodiment is configured to be fixed to a circuit board, and another end of the coaxial connector 100 is configured to be mated by a related signal transmitting wire, but the manner of application of the coaxial connector 100 of the present disclosure is not limited thereto.

Referring to FIG. 1 to FIG. 4, the shell 1 defines a first end 1A and a second end 1B opposite to each other. The shell 1 has a central passage 1C penetrating through the shell 1 along an axial direction D. The central passage 1C is configured to accommodate the fixing member 3. The shell 1 includes a first annular portion 11, a second annular portion 12, an annular engaging portion 13, an annular abutting portion 14, and an annular guiding portion 15. The shell 1 sequentially includes the annular guiding portion 15, the first annular portion 11, the annular engaging portion 13, the second annular portion 12, and the annular abutting portion 14 from the first end 1A to the second end 1B. In other embodiments, the shell 1 of the coaxial connector 100 can be provided without the annular guiding portion 15.

The first annular portion 11 is arranged near the first end 1A. The first annular portion 11 is connected to the annular guiding portion 15 and the annular engaging portion 13, and the first annular portion 11 is arranged between the annular guiding portion 15 and the annular engaging portion 13. Preferably, an inner diameter 11D of the first annular portion 11 is substantially equal to a minimum inner diameter 15D1 of the annular guiding portion 15.

The second annular portion 12 is connected to the annular engaging portion 13. An inner diameter 12D of the second annular portion 12 is greater than the inner diameter 11D of the first annular portion 11. The inner diameter 12D of the second annular portion 12 is substantially equal to a maximum inner diameter 13D2 of the annular engaging portion 13. Preferably, the inner diameter 12D of the second annular portion 12 is substantially equal to the maximum inner diameter 13D2 of the annular engaging portion 13.

An inner diameter of the annular engaging portion 13 gradually increases from the first end 1A to the second end 1B, and the annular engaging portion 13 has a first annular inclined surface 131. Preferably, a minimum inner diameter 13D1 of the annular engaging portion 13 is substantially equal to the inner diameter 11D of the first annular portion 11.

The annular abutting portion 14 is arranged at the second end 1B of the shell 1, and an inner diameter 14D of the annular abutting portion 14 is less than the inner diameter 12D of the second annular portion 12. The annular guiding portion 15 is connected to the first annular portion 11, the first annular portion 11 is arranged between the annular guiding portion 15 and the annular engaging portion 13, an inner diameter of the annular guiding portion 15 gradually decreases from the first end 1A to the second end 1B, and the minimum inner diameter 15D1 of the annular guiding portion 15 can be equal to the inner diameter 11D of the first annular portion 11.

The core body 2 is disposed in the shell 1. The core body 2 can transmit a signal, materials and components of the core body 2 can be determined according to a frequency of the signal that is required to be transmitted, and the present disclosure is not limited thereto. One end of the core body 2 is configured to be fixed to a circuit board, another end of the core body 2 can have a holding structure 21, and the holding structure 21 can be mated by an inner core in the signal transmitting wire. In other embodiments, the core body 2 can have two holding structures 21 at two ends thereof, respectively, and two ends of the coaxial connector 100 can be mated by the inner core in the signal transmitting wire.

The fixing member 3 has a thru-hole 3A penetrating through the fixing member 3 along the axial direction D. One portion of the core body 2 is fixed in the thru-hole 3A, and the fixing member 3 is disposed in the central passage 1C. The fixing member 3 includes a first portion 31, a second portion 32, an engaging portion 33, and a guiding portion 34. Ratios among a length 31L of the first portion 31, a length 32L of the second portion 32, a length 33L of the engaging portion 33, and a length 34L of the guiding portion 34 along the axial direction D are not limited to those shown in the figures of the present disclosure. The fixing member 3 defines a third end 3B and a fourth end 3C opposite to each other, and the fixing member 3 sequentially includes the first portion 31, the engaging portion 33, the second portion 32, and the guiding portion 34 from the third end 3B to the fourth end 3C. The fixing member 3 is disposed in the central passage 1C of the shell 1, the third end 3B of the fixing member 3 is arranged near the first end 1A of the shell 1, and the fourth end 3C of the fixing member 3 is arranged near the second end 1B of the shell 1. It should be noted that in other embodiments, the fixing member 3 can be provided without the guiding portion 34.

The first portion 31 is arranged near the third end 3B, and an outer diameter 31D of the first portion 31 is less than the inner diameter 11D of the first annular portion 11. An outer diameter 32D of the second portion 32 is greater than the outer diameter 31D of the first portion 31, and the outer diameter 32D of the second portion 32 is less than the inner diameter 12D of the second annular portion 12.

The engaging portion 33 is connected to the first portion 31 and the second portion 32, and the engaging portion 33 is arranged between the first portion 31 and the second portion 32. An outer diameter of the engaging portion 33 gradually increases from the third end 3B to the fourth end 3C, and the engaging portion 33 has a second annular inclined surface 331. The outer diameter 32D of the second portion 32 is substantially equal to a maximum outer diameter 33D2 of the engaging portion 33.

The guiding portion 34 is arranged at the fourth end 3C of the fixing member 3, the guiding portion 34 is connected to the second portion 32, and the second portion 32 is arranged between the guiding portion 34 and the engaging portion 33. An outer diameter of the guiding portion 34 gradually decreases from the third end 3B to the fourth end 3C, and a maximum outer diameter 34D2 of the guiding portion 34 is substantially equal to the outer diameter 32D of the second portion 32.

It is worth mentioning that, the annular abutting portion 14 has a first annular abutting surface 141 at one end thereof near the second annular portion 12. The fixing member 3 has a second annular abutting surface 37 at the fourth end 3C. In an embodiment of the present disclosure, the fixing member 3 includes the guiding portion 34, and an end surface of the guiding portion 34 is the second annular abutting surface 37.

According to the above, the core body 2 is fixed in the central passage 1C through the fixing member 3, the annular engaging portion 13 and the annular abutting portion 14 jointly hold the engaging portion 33 and the second portion 32, the second annular abutting surface 37 and the first annular abutting surface 141 abut against each other, and one portion of the first annular inclined surface 131 and one portion of the second annular inclined surface 331 abut against each other. In this way, when the coaxial connector 100 transmits a high-frequency signal having a frequency of 10 GHz, a convex wave issue of a conventional coaxial connector does not easily occur.

It is worth mentioning that, the shell 1 has a first end surface 18 at the first end 1A, a length from the first annular abutting surface 141 along the axial direction D to a position of the annular engaging portion 13 having the maximum inner diameter 13D2 is defined as a first length L1, a length from the first end surface 18 along the axial direction D to the first annular abutting surface 141 is defined as a second length L2, and the first length L1 is less than the second length L2.

The fixing member 3 has a second end surface 38 near the third end 3B, a length from the second annular abutting surface 37 along the axial direction D to a positon of the engaging portion 33 having the maximum outer diameter 33D2 is defined as a third length L3, a length from the second end surface 38 along the axial direction D to the second annular abutting surface 37 is defined as a fourth length L4, the third length L3 is less than the fourth length L4, and the first length L1 is less than the third length L3.

A length from the first end surface 18 along the axial direction D to a position of the annular engaging portion 13 having the minimum inner diameter 13D1 is defined as a fifth length L5, and the fifth length L5 is less than the first length L1. A length from the second end surface 38 along the axial direction D to a position of the engaging portion 33 having a minimum outer diameter 33D1 is defined as a sixth length L6, and the sixth length L6 is less than the fourth length L4.

Reference is further made to FIG. 1, in which the coaxial connector 100 can further include an auxiliary fixing member 4 fixed in the fixing member 3. The auxiliary fixing member 4 includes a central thru-hole 4A, and the core body 2 penetrates through the central thru-hole 4A. The auxiliary fixing member 4 can allow the core body 2 to be more stably fixed in the fixing member 3. The structure and the dimension of the auxiliary fixing member 4 can be changed according to practical requirements, and the figure only shows one implementation of the present disclosure.

However, the aforementioned description for the coaxial connector 100 of the first embodiment is merely an example and is not meant to limit the scope of the present disclosure.

Second Embodiment

Referring to FIG. 6 to FIG. 13, the differences between the present embodiment and the first embodiment are as follows.

The shell 1 includes the first annular portion 11, the second annular portion 12, the annular engaging portion 13, the annular abutting portion 14, an annular step difference portion 16, an annular connection portion 17, and the annular guiding portion 15. The shell 1 sequentially includes the annular guiding portion 15, the first annular portion 11, the annular engaging portion 13, the second annular portion 12, the annular step difference portion 16, the annular connection portion 17, and the annular abutting portion 14 from the first end 1A to the second end 1B. In other embodiments, the coaxial connector 100 of the present embodiment can be provided without at least one of the annular step difference portion 16, the annular connection portion 17, and the annular guiding portion 15.

The first annular portion 11 is arranged near the first end 1A. The inner diameter 12D of the second annular portion 12 is greater than the inner diameter 11D of the first annular portion 11. The annular engaging portion 13 is connected to the first annular portion 11 and the second annular portion 12, and the annular engaging portion 13 is arranged between the first annular portion 11 and the second annular portion 12.

The inner diameter of the annular engaging portion 13 gradually increases from the first end 1A to the second end 1B, and the annular engaging portion 13 has the first annular inclined surface 131. The minimum inner diameter 13D1 of the annular engaging portion 13 can be substantially equal to the inner diameter 11D of the first annular portion 11, and the maximum inner diameter 13D2 of the annular engaging portion 13 is less than or equal to the inner diameter 12D of the second annular portion 12.

The annular step difference portion 16 is connected to the second annular portion 12, an inner diameter of the annular step difference portion 16 gradually decreases from the first end 1A to the second end 1B, a maximum inner diameter 16D2 of the annular step difference portion 16 is less than the inner diameter 12D of the second annular portion 12, and a minimum inner diameter 16D1 of the annular step difference portion 16 can be substantially equal to the inner diameter 11D of the first annular portion 11.

The annular connection portion 17 is connected to the annular step difference portion 16 and the annular abutting portion 14, and the annular connection portion 17 is arranged between the annular step difference portion 16 and the annular abutting portion 14. An inner diameter 17D of the annular connection portion 17 is greater than or equal to the minimum inner diameter 16D1 of the annular step difference portion 16. Preferably, the inner diameter 17D of the annular connection portion 17 can be substantially equal to the minimum inner diameter 16D1 of the annular step difference portion 16. The inner diameter 17D of the annular connection portion 17 is greater than the inner diameter 14D of the annular abutting portion 14. The inner diameter 17D of the annular connection portion 17 is greater than or equal to the inner diameter 11D of the first annular portion 11. Preferably, the inner diameter 17D of the annular connection portion 17 is equal to the inner diameter 11D of the first annular portion 11.

The annular abutting portion 14 is arranged near the second end 1B, and the inner diameter 14D of the annular abutting portion 14 is less than the inner diameter 12D of the second annular portion 12. It should be noted that, in an embodiment of the present disclosure, the coaxial connector 100 does not include the annular connection portion 17 and the annular step difference portion 16, and the annular abutting portion 14 is directly in contact with the second annular portion 12.

The annular guiding portion 15 is connected to the first annular portion 11, the first annular portion 11 is arranged between the annular guiding portion 15 and the annular engaging portion 13, the inner diameter of the annular guiding portion 15 gradually decreases from the first end 1A to the second end 1B, and the minimum inner diameter 15D1 of the annular guiding portion 15 is greater than or equal to the inner diameter 11D of the first annular portion 11. Preferably, the minimum inner diameter 15D1 of the annular guiding portion 15 is substantially equal to the inner diameter 11D of the first annular portion 11.

The fixing member 3 includes the first portion 31, the second portion 32, the engaging portion 33, the guiding portion 34, a step difference portion 35, and an abutting portion 36. The fixing member 3 defines the third end 3B and the fourth end 3C opposite to each other, and the fixing member 3 sequentially includes the first portion 31, the engaging portion 33, the second portion 32, the step difference portion 35, the abutting portion 36, and the guiding portion 34 from the third end 3B to the fourth end 3C. When the fixing member 3 is disposed in the central passage 1C of the shell 1, the third end 3B of the fixing member 3 is arranged near the first end 1A of the shell 1, and the fourth end 3C of the fixing member 3 is arranged near the second end 1B of the shell 1. It should be noted that in other embodiments, the fixing member 3 can be provided without at least one of the step difference portion 35 and the guiding portion 34. In an embodiment of the present disclosure, the fixing member 3 does not include the step difference portion 35, and the abutting portion 36 is directly in contact with the second portion 32.

The first portion 31 is arranged near the third end 3B, and the outer diameter 31D of the first portion 31 is less than the inner diameter 11D of the first annular portion 11. The outer diameter 32D of the second portion 32 is greater than the outer diameter 31D of the first portion 31, and the outer diameter 32D of the second portion 32 is less than the inner diameter 12D of the second annular portion 12.

The engaging portion 33 is connected to the first portion 31 and the second portion 32, and the engaging portion 33 is arranged between the first portion 31 and the second portion 32. The outer diameter of the engaging portion 33 gradually increases from the third end 3B to the fourth end 3C, and the engaging portion 33 has the second annular inclined surface 331. The outer diameter 32D of the second portion 32 is greater than or equal to the maximum outer diameter 33D2 of the engaging portion 33, and preferably, the outer diameter 32D of the second portion 32 is substantially equal to the maximum outer diameter 33D2 of the engaging portion 33.

The step difference portion 35 is connected to the second portion 32, an outer diameter of the step difference portion 35 gradually decreases from the third end 3B to the fourth end 3C, and a maximum outer diameter 35D2 of the step difference portion 35 is less than or equal to the outer diameter 32D of the second portion 32. Preferably, the maximum outer diameter 35D2 of the step difference portion 35 is substantially equal to the outer diameter 32D of the second portion 32.

The abutting portion 36 is arranged near the fourth end 3C and connected to the step difference portion 35, the step difference portion 35 is arranged between the abutting portion 36 and the second portion 32, and a minimum outer diameter 35D1 of the step difference portion 35 is less than or equal to an outer diameter 36D of the abutting portion 36. Preferably, the minimum outer diameter 35D1 of the step difference portion 35 is substantially equal to the outer diameter 36D of the abutting portion 36. The outer diameter 36D of the abutting portion 36 is less than the outer diameter 32D of the second portion 32, and the outer diameter 36D of the abutting portion 36 is less than or equal to the outer diameter 31D of the first portion 31. In an embodiment of the present disclosure, the outer diameter 36D of the abutting portion 36 can be substantially equal to the outer diameter 31D of the first portion 31. The outer diameter 36D of the abutting portion 36 is less than the inner diameter 17D of the annular connection portion 17. In an embodiment of the present disclosure, the fixing member 3 of the coaxial connector 100 does not include the step difference portion 35, and the abutting portion 36 is directly connected to the second portion 32.

The guiding portion 34 is arranged at the fourth end 3C of the fixing member 3, the guiding portion 34 is connected to the abutting portion 36, and the abutting portion 36 is arranged between the guiding portion 34 and the step difference portion 35. The outer diameter of the guiding portion 34 gradually decreases from the third end 3B to the fourth end 3C, the maximum outer diameter 34D2 of the guiding portion 34 is less than or equal to the outer diameter 36D of the abutting portion 36, and the maximum outer diameter 34D2 of the guiding portion 34 is less than or equal to the outer diameter 32D of the second portion 32. The maximum outer diameter 34D2 of the guiding portion 34 can be substantially equal to the outer diameter 36D of the abutting portion 36.

It is worth mentioning that the annular abutting portion 14 has the first annular abutting surface 141 at one end thereof near the second annular portion 12. The fixing member 3 has the second annular abutting surface 37 at the fourth end 3C. In an embodiment of the present disclosure, the fixing member 3 has the guiding portion 34, and one end surface of the guiding portion 34 is the second annular abutting surface 37.

According to the above, in the coaxial connector 100 of the present embodiment, the core body 2 is fixed in the central passage 1C through the fixing member 3, and the annular engaging portion 13 and the annular abutting portion 14 jointly hold the engaging portion 33 and the second portion 32. The second annular abutting surface 37 and the first annular abutting surface 141 abut against each other, the one portion of the first annular inclined surface 131 and the one portion of the second annular inclined surface 331 abut against each other, and a first annular step difference inclined surface 161 of the annular step difference portion 16 is not in contact with a second annular step difference inclined surface 351 of the step difference portion 35.

It is worth mentioning that, the shell 1 has the first end surface 18 at the first end 1A, the length from the first annular abutting surface 141 along the axial direction D to the position of the annular engaging portion 13 having the maximum inner diameter 13D2 is defined as the first length L1, the length from the first end surface 18 along the axial direction D to the first annular abutting surface 141 is defined as the second length L2, and the first length L1 is less than the second length L2. The fixing member 3 has the second end surface 38 near the third end 3B, the length from the second annular abutting surface 37 along the axial direction D to the positon of the engaging portion 33 having the maximum outer diameter 33D2 is defined as the third length L3, the length from the second end surface 38 along the axial direction D to the second annular abutting surface 37 is defined as the fourth length L4, the third length L3 is less than the fourth length L4, and the first length L1 is less than the third length L3.

However, the aforementioned description for the coaxial connector 100 of the second embodiment is merely an example and is not meant to limit the scope of the present disclosure.

Third Embodiment

Referring to FIG. 14 to FIG. 20, one of the differences between the present embodiment and the above-mentioned second embodiment is as follows. The shell 1 sequentially includes the annular guiding portion 15, the first annular portion 11, the annular step difference portion 16, the annular connection portion 17, the annular engaging portion 13, the second annular portion 12, and the annular abutting portion 14 from the first end 1A to the second end 1B. The fixing member 3 sequentially includes a head portion 39, the first portion 31, the engaging portion 33, the second portion 32, and the guiding portion 34 from the third end 3B to the fourth end 3C. Ratios among a length 13L of the annular engaging portion 13, a length 16L of the annular step difference portion 16, a length 17L of the annular connection portion 17, the length 31L of the first portion 31, and the length 33L of the engaging portion 33 along the axial direction D are not limited to those shown in the figures of the present disclosure.

Another one of the differences between the present embodiment and the above-mentioned second embodiment is as follows. The length from the first annular abutting surface 141 along the axial direction D to the position of the annular engaging portion 13 having the maximum inner diameter 13D2 is defined as the first length L1, the length from the first end surface 18 along the axial direction D to the first annular abutting surface 141 is defined as the second length L2, and the first length L1 is less than the second length L2. The length from the second annular abutting surface 37 along the axial direction D to the positon of the engaging portion 33 having the maximum outer diameter 33D2 is defined as the third length L3, the length from the second end surface 38 along the axial direction D to the second annular abutting surface 37 is defined as the fourth length L4, the third length L3 is less than the fourth length L4, and the first length L1 is less than the third length L3.

A length of the shell 1 along the axial direction D from the first annular abutting surface 141 to a position of the annular step difference portion 16 having the maximum inner diameter 16D2 is defined as a fifth length L5, a length of the fixing member 3 along the axial direction D from the second annular abutting surface 37 to a position where the head portion 39 and the first portion 31 are connected to each other is defined as a sixth length L6, the sixth length L6 is greater than the fifth length L5, the fifth length L5 is less than the first length L1, and the sixth length L6 is less than the fourth length L4.

The difference between the shell 1 of the present embodiment and the shell 1 of the above-mentioned second embodiment is as follows. The annular guiding portion 15 is connected to the first annular portion 11, and the first annular portion 11 is arranged between the annular guiding portion 15 and the annular step difference portion 16. The inner diameter of the annular guiding portion 15 gradually decreases from the first end 1A to the second end 1B, and the minimum inner diameter 15D1 of the annular guiding portion 15 is greater than or equal to the inner diameter 11D of the first annular portion 11. Preferably, the minimum inner diameter 15D1 of the annular guiding portion 15 is substantially equal to the inner diameter 11D of the first annular portion 11.

The first annular portion 11 is connected to the annular guiding portion 15. The inner diameter 11D of the first annular portion 11 is greater than an outer diameter 39D of the head portion 39 of the fixing member 3. The annular step difference portion 16 is connected to the first annular portion 11, the inner diameter of the annular step difference portion 16 gradually decreases from the first end 1A to the second end 1B, and the maximum inner diameter 16D2 of the annular step difference portion 16 is less than or equal to the inner diameter 11D of the first annular portion 11. Preferably, the maximum inner diameter 16D2 of the annular step difference portion 16 is substantially equal to the inner diameter 11D of the first annular portion 11.

The annular connection portion 17 is connected to the annular step difference portion 16 and the annular engaging portion 13, and the annular connection portion 17 is arranged between the annular step difference portion 16 and the annular engaging portion 13. The inner diameter 17D of the annular connection portion 17 is less than or equal to the minimum inner diameter 16D1 of the annular step difference portion 16, and the inner diameter 17D of the annular connection portion 17 is less than or equal to the minimum inner diameter 13D1 of the annular engaging portion 13. Preferably, the inner diameter 17D of the annular connection portion 17 is substantially equal to the minimum inner diameter 16D1 of the annular step difference portion 16, and the inner diameter 17D of the annular connection portion 17 is substantially equal to the minimum inner diameter 13D1 of the annular engaging portion 13.

The inner diameter 17D of the annular connection portion 17 is less than the inner diameter 11D of the first annular portion 11, and the inner diameter 17D of the annular connection portion 17 is less than the inner diameter 12D of the second annular portion 12.

The inner diameter 17D of the annular connection portion 17 is greater than the outer diameter 31D of the first portion 31. The minimum inner diameter 16D1 of the annular step difference portion 16 is greater than the outer diameter 31D of the first portion 31, and when the fixing member 3 is fixed in the shell 1, the first annular step difference inclined surface 161 of the annular step difference portion 16 is not in contact with the fixing member 3.

The maximum inner diameter 13D2 of the annular engaging portion 13 is substantially equal to the inner diameter 12D of the second annular portion 12, and the minimum inner diameter 13D1 of the annular engaging portion 13 is substantially equal to the inner diameter 17D of the annular connection portion 17. The inner diameter 12D of the second annular portion 12 is greater than the outer diameter 32D of the second portion 32.

The difference between the fixing member 3 of the present embodiment and the fixing member 3 of the previous embodiment is as follows. The fixing member 3 includes the head portion 39 at the third end 3B, the head portion 39 is connected to the first portion 31, the first portion 31 is arranged between the head portion 39 and the engaging portion 33, and the outer diameter 39D of the head portion 39 is greater than the outer diameter 31D of the first portion 31. The outer diameter 39D of the head portion 39 is less than or equal to the outer diameter 32D of the second portion 32. Preferably, the outer diameter 39D of the head portion 39 is substantially equal to the outer diameter 32D of the second portion 32.

The second portion 32 is connected to the engaging portion 33, and the outer diameter 32D of the second portion 32 is greater than or equal to the maximum outer diameter 33D2 of the engaging portion 33. Preferably, the outer diameter 32D of the second portion 32 is substantially equal to the maximum outer diameter 33D2 of the engaging portion 33.

The guiding portion 34 is connected to the second portion 32. The guiding portion 34 is arranged at the fourth end 3C of the fixing member 3. One end surface of the guiding portion 34 is the second annular abutting surface 37, and the outer diameter of the guiding portion 34 gradually decreases from the third end 3B to the fourth end 3C. The maximum outer diameter 34D2 of the guiding portion 34 is less than or equal to the outer diameter 32D of the second portion 32, and the maximum outer diameter 34D2 of the guiding portion 34 is less than or equal to the outer diameter 39D of the head portion 39. Preferably, the maximum outer diameter 34D2 of the guiding portion 34 is substantially equal to the outer diameter 32D of the second portion 32, and the maximum outer diameter 34D2 of the guiding portion 34 is substantially equal to the outer diameter 39D of the head portion 39.

Figure 21:
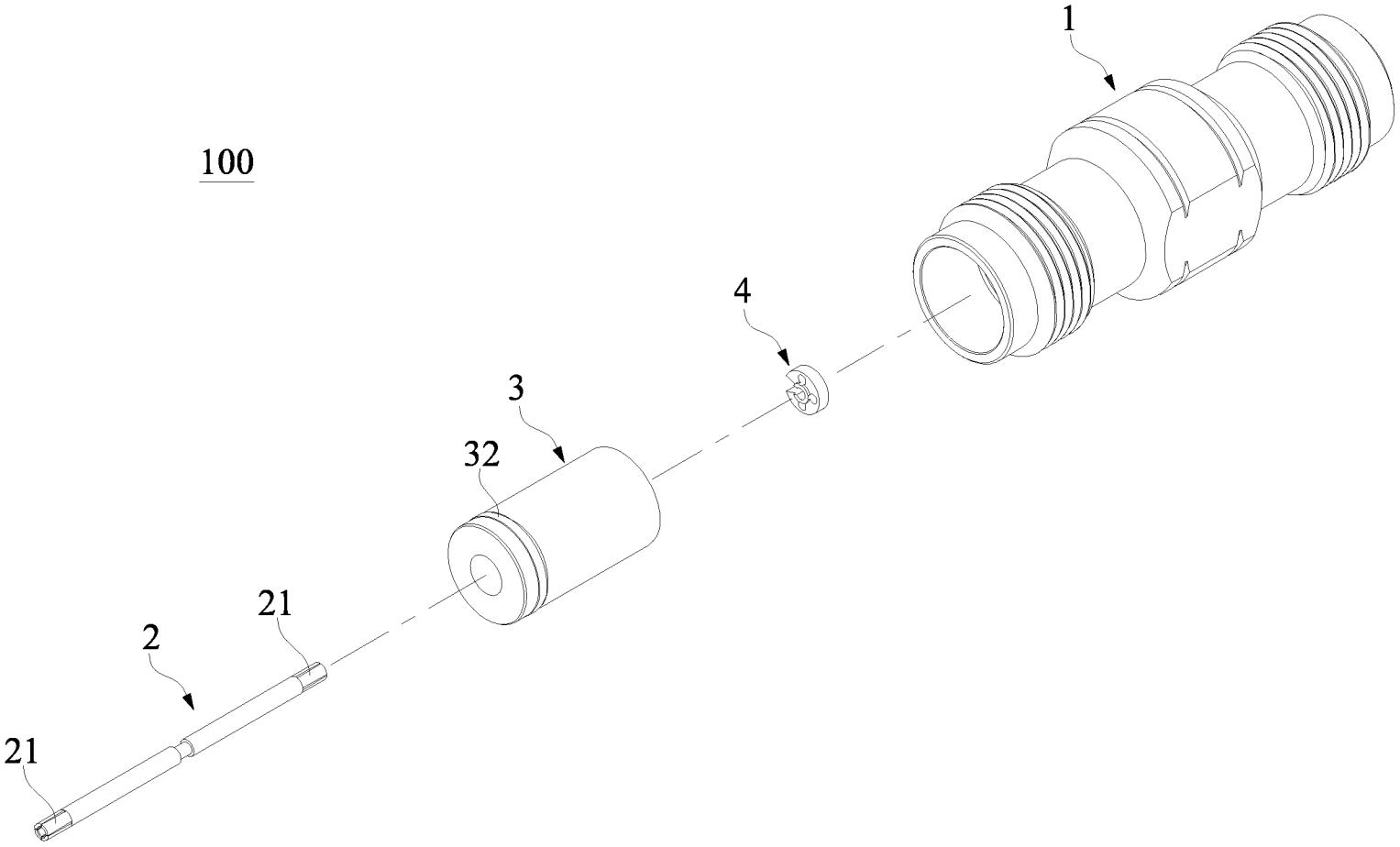
FIG. 21 is an exploded view of the coaxial connector according to a fifth embodiment of the present disclosure.

Referring to FIG. 21, the difference between the present embodiment and the previous embodiment is that the core body 2 has two holding structures 21 at two ends thereof, respectively, and the two holding structures 21 are configured to be mated by two inner cores of two signal transmitting wires. In other words, the coaxial connector 100 of the present disclosure can be a connector for two signal transmitting wires. The description of shell 1, the fixing member 3, and the auxiliary fixing member 4 included in the coaxial connector 100 of the present embodiment can be referred to in the previous embodiments, and will not be reiterated herein.

However, the aforementioned description for the coaxial connector 100 of the third embodiment is merely an example and is not meant to limit the scope of the present disclosure.

Beneficial Effects of the Embodiments

In conclusion, in the coaxial connector of the present disclosure, through the cooperation of the first annular portion, the second annular portion, the annular engaging portion, and the annular abutting portion included in the shell, and the first portion, the second portion, and the engaging portion included in the fixing member, the second annular abutting surface of the fixing member and the first annular abutting surface can tightly abut against each other. In this way, when the coaxial connector transmits a high frequency signal having a frequency higher than 10 GHz, issues relating to convex waves does not easily occur.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A coaxial connector, comprising:

a shell defining a first end and a second end opposite to each other, wherein the shell has a central passage penetrating through the shell along an axial direction, and wherein the shell includes:

a first annular portion arranged near the first end;

a second annular portion having an inner diameter greater than or equal to an inner diameter of the first annular portion;

an annular engaging portion connected to the first annular portion and the second annular portion and arranged between the first annular portion and the second annular portion, wherein an inner diameter of the annular engaging portion gradually increases from the first end to the second end, and the annular engaging portion has a first annular inclined surface, and wherein a minimum inner diameter of the annular engaging portion is less than or equal to the inner diameter of the first annular portion; and an annular abutting portion arranged near the second end and connected to the second annular portion, wherein an inner diameter of the annular abutting portion is less than an inner diameter of the second annular portion, and the annular abutting portion has a first annular abutting surface at one end thereof near the second annular portion;

a core body having at least one portion disposed in the shell; and a fixing member having a thru-hole, wherein one portion of the core body is fixed in the thru-hole, the fixing member is disposed in the central passage, the fixing member defines a third end and a fourth end opposite to each other, and the fixing member includes:

a first portion arranged near the third end, wherein an outer diameter of the first portion is less than the inner diameter of the first annular portion;

a second portion having an outer diameter greater than the outer diameter of the first portion, wherein the outer diameter of the second portion is less than the inner diameter of the second annular portion; and an engaging portion connected to the first portion and the second portion and arranged between the first portion and the second portion, wherein an outer diameter of the engaging portion gradually increases from the third end to the fourth end, and the engaging portion has a second annular inclined surface, and wherein the outer diameter of the second portion is greater than or equal to a maximum outer diameter of the engaging portion;

wherein the fixing member has a second annular abutting surface at the fourth end, wherein the core body is fixed in the central passage through the fixing member, the annular engaging portion and the annular abutting portion jointly hold the engaging portion and the second portion, the second annular abutting surface and the first annular abutting surface abut against each other, and one portion of the first annular inclined surface and one portion of the second annular inclined surface abut against each other.

2. The coaxial connector according to claim 1, wherein the shell has a first end surface at the first end, a length from the first annular abutting surface along the axial direction to a position of the annular engaging portion having a maximum inner diameter is defined as a first length, and a length from the first end surface along the axial direction to the first annular abutting surface is defined as a second length, and wherein the fixing member has a second end surface at the third end, a length from the second annular abutting surface along the axial direction to a position of the engaging portion having the maximum outer diameter is defined as a third length, a length from the second end surface along the axial direction to the second annular abutting surface is defined as a fourth length, and the third length is less than the fourth length.

3. The coaxial connector according to claim 2, wherein the shell further includes:

an annular step difference portion connected to the second annular portion, wherein an inner diameter of the annular step difference portion gradually decreases from the first end to the second end, and a maximum inner diameter of the annular step difference portion is less than the inner diameter of the second annular portion, and wherein a minimum inner diameter of the annular step difference portion is greater than or equal to the inner diameter of the first annular portion; and an annular connection portion connected to the annular step difference portion and the annular abutting portion and arranged between the annular step difference portion and the annular abutting portion, wherein an inner diameter of the annular connection portion is greater than or equal to the minimum inner diameter of the annular step difference portion, and the inner diameter of the annular connection portion is greater than the inner diameter of the annular abutting portion, and wherein the inner diameter of the annular connection portion is greater than or equal to the inner diameter of the first annular portion;

wherein the fixing member further includes:

a step difference portion connected to the second portion, wherein an outer diameter of the step difference portion gradually decreases from the third end to the fourth end, a maximum outer diameter of the step difference portion is less than or equal to the outer diameter of the first portion, and the maximum outer diameter of the step difference portion is less than or equal to the outer diameter of the second portion; and an abutting portion connected to the step difference portion, wherein the step difference portion is arranged between the abutting portion and the second portion, a minimum outer diameter of the step difference portion is less than or equal to an outer diameter of the abutting portion, the outer diameter of the abutting portion is less than the outer diameter of the second portion, the outer diameter of the abutting portion is less than or equal to the minimum outer diameter of the step difference portion, the abutting portion is arranged near the fourth end, and the inner diameter of the annular connection portion is greater than the outer diameter of the abutting portion;

wherein a first annular step difference inclined surface of the annular step difference portion is not in contact with a second annular step difference inclined surface of the step difference portion.

4. The coaxial connector according to claim 3, wherein the shell further includes:

an annular guiding portion arranged at the first end of the shell, wherein the annular guiding portion is connected to the first annular portion, the first annular portion is arranged between the annular guiding portion and the annular engaging portion, an inner diameter of the annular guiding portion gradually decreases from the first end to the second end, and a minimum inner diameter of the annular guiding portion is greater than or equal to the inner diameter of the first annular portion;

wherein the fixing member further includes:

a guiding portion having an end surface being the second annular abutting surface, wherein the guiding portion is connected to the abutting portion, the abutting portion is arranged between the guiding portion and the step difference portion, an outer diameter of the guiding portion gradually decreases from the third end to the fourth end, and a maximum outer diameter of the guiding portion is less than or equal to the outer diameter of the abutting portion.

5. The coaxial connector according to claim 1, wherein the shell has a first end surface at the first end, a length from the first annular abutting surface along the axial direction to a position of the annular engaging portion having a maximum inner diameter is defined as a first length, a length from the first end surface along the axial direction to the first annular abutting surface is defined as a second length, and the first length is less than the second length, and wherein the fixing member has a second end surface at the third end, a length from the second annular abutting surface along the axial direction to a position of the engaging portion having the maximum outer diameter is defined as a third length, a length from the second end surface along the axial direction to the second annular abutting surface is defined as a fourth length, the third length is less than the fourth length, and the first length is less than the third length.

6. The coaxial connector according to claim 5, wherein the shell further includes:

an annular step difference portion connected to the first annular portion, an inner diameter of the annular step difference portion gradually decreases from the first end to the second end, and a maximum inner diameter of the annular step difference portion is less than or equal to the inner diameter of the first annular portion; and an annular connection portion connected to the annular step difference portion and the annular engaging portion and arranged between the annular step difference portion and the annular engaging portion, wherein an inner diameter of the annular connection portion is less than or equal to a minimum inner diameter of the annular step difference portion, and the inner diameter of the annular connection portion is less than or equal to the minimum inner diameter of the annular engaging portion, and wherein the inner diameter of the annular connection portion is less than the inner diameter of the first annular portion, and the inner diameter of the annular connection portion is less than the inner diameter of the second annular portion;

wherein a first annular step difference inclined surface of the annular step difference portion is not in contact with the fixing member, the inner diameter of the annular connection portion is greater than the outer diameter of the first portion, and the minimum inner diameter of the annular step difference portion is greater than the outer diameter of the first portion;

wherein the fixing member further includes:

a head portion arranged at the third end, wherein the head portion is connected to the first portion, the first portion is arranged between the head portion and the engaging portion, an outer diameter of the head portion is greater than the outer diameter of the first portion, the outer diameter of the head portion is less than the inner diameter of the first annular portion, and the outer diameter of the head portion is less than or equal to the outer diameter of the second portion.

7. The coaxial connector according to claim 6, wherein the shell further includes:

an annular guiding portion connected to the first annular portion, and the first annular portion is arranged between the annular guiding portion and the annular step difference portion, wherein an inner diameter of the annular guiding portion gradually decreases from the first end to the second end, and a minimum inner diameter of the annular guiding portion is greater than or equal to the inner diameter of the first annular portion;

wherein the fixing member further includes:

a guiding portion having an end surface being the second annular abutting surface, wherein an outer diameter of the guiding portion gradually decreases from the third end to the fourth end, a maximum outer diameter of the guiding portion is less than or equal to the outer diameter of the second portion, and the maximum outer diameter of the guiding portion is less than or equal to the outer diameter of the head portion.

8. The coaxial connector according to claim 7, wherein a length of the shell along the axial direction from the first annular abutting surface to a position of the annular step difference portion having the maximum inner diameter is defined as a fifth length, a length of the fixing member along the axial direction from the second annular abutting surface to a position where the head portion is connected to the first portion is defined as a sixth length, the sixth length is greater than the fifth length, the fifth length is less than the first length, and the sixth length is less than the fourth length.

9. The coaxial connector according to claim 1, wherein the shell has a first end surface at the first end, a length from the first annular abutting surface along the axial direction to a position of the annular engaging portion having a maximum inner diameter is defined as a first length, a length from the first end surface along the axial direction to the first annular abutting surface is defined as a second length, and the first length is less than the second length, and wherein the fixing member has a second end surface at the third end, a length from the second annular abutting surface along the axial direction to a position of the engaging portion having the maximum outer diameter is defined as a third length, a length from the second end surface along the axial direction to the second annular abutting surface is defined as a fourth length, the third length is less than the fourth length, and the first length is less than the third length.

10. The coaxial connector according to claim 9, wherein the inner diameter of the first annular portion is greater than the outer diameter of the first portion, and the inner diameter of the second annular portion is greater than the outer diameter of the second portion.

11. The coaxial connector according to claim 10, wherein the shell further includes:

an annular guiding portion arranged at the first end of the shell, wherein the annular guiding portion is connected to the first annular portion, the first annular portion is arranged between the annular guiding portion and the annular engaging portion, an inner diameter of the annular guiding portion gradually decreases from the first end to the second end, and a minimum inner diameter of the annular guiding portion is greater than or equal to the inner diameter of the first annular portion;

wherein the fixing member further includes:

a guiding portion having an end surface being the second annular abutting surface, wherein the guiding portion is connected to the second portion, the second portion is arranged between the guiding portion and the engaging portion, an outer diameter of the guiding portion gradually decreases from the third end to the fourth end, and a maximum outer diameter of the guiding portion is less than or equal to the outer diameter of the second portion.

12. The coaxial connector according to claim 1, wherein the shell has a first end surface at the first end, a length from the first annular abutting surface along the axial direction to a position of the annular engaging portion having a maximum inner diameter is defined as a first length, a length from the first end surface along the axial direction to the first annular abutting surface is defined as a second length, and the first length is less than the second length, and wherein the fixing member has a second end surface at the third end, a length from the second annular abutting surface along the axial direction to a position of the engaging portion having the maximum outer diameter is defined as a third length, a length from the second end surface along the axial direction to the second annular abutting surface is defined as a fourth length, the third length is less than the fourth length, and the first length is less than the third length.

13. The coaxial connector according to claim 12, wherein the inner diameter of the first annular portion is greater than the outer diameter of the first portion, and the inner diameter of the second annular portion is greater than the outer diameter of the second portion.

14. The coaxial connector according to claim 13, wherein the shell further includes:

an annular guiding portion arranged at the first end of the shell, wherein the annular guiding portion is connected to the first annular portion, the first annular portion is arranged between the annular guiding portion and the annular engaging portion, an inner diameter of the annular guiding portion gradually decreases from the first end to the second end, and a minimum inner diameter of the annular guiding portion is greater than or equal to the inner diameter of the first annular portion;

wherein the fixing member further includes:

a guiding portion having an end surface being the second annular abutting surface, wherein the guiding portion is connected to the second portion, the second portion is arranged between the guiding portion and the engaging portion, an outer diameter of the guiding portion gradually decreases from the third end to the fourth end, and a maximum outer diameter of the guiding portion is less than or equal to the outer diameter of the second portion.

* * * * *